US006474774B1

(12) United States Patent
Okamoto

(10) Patent No.: US 6,474,774 B1
(45) Date of Patent: Nov. 5, 2002

(54) CAPPING OF INK JET RECORDING HEAD

(75) Inventor: Hideaki Okamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 09/671,859

(22) Filed: Sep. 28, 2000

(30) Foreign Application Priority Data

Sep. 29, 1999 (JP) ..... 11-276539
Sep. 25, 2000 (JP) ..... 2000-290155

(51) Int. Cl.[7] ..... B41J 2/165
(52) U.S. Cl. ..... 347/32
(58) Field of Search ..... 347/32, 22, 23, 347/29, 104

(56) References Cited

U.S. PATENT DOCUMENTS

| | | | | |
|---|---|---|---|---|
| 4,731,639 A | * | 3/1988 | Gutmann et al. | 347/32 X |
| 5,040,000 A | | 8/1991 | Yokoi | |
| 5,051,761 A | * | 9/1991 | Fisher et al. | 347/30 |
| 5,226,741 A | * | 7/1993 | Kumazaki et al. | 400/579 |
| 5,341,163 A | | 8/1994 | Hanabusa | 347/23 |
| 5,436,652 A | * | 7/1995 | Mizoguchi et al. | 347/108 |
| 5,627,570 A | * | 5/1997 | Hiramatsu et al. | 347/19 |
| 5,627,572 A | * | 5/1997 | Harrington, III et al. | 347/23 |
| 5,890,823 A | | 4/1999 | Chang et al. | 400/702.1 |
| 6,270,183 B1 | * | 8/2001 | Gaarder | 347/29 |

FOREIGN PATENT DOCUMENTS

| | | | |
|---|---|---|---|
| DE | 197 26 971 | 12/1998 | |
| EP | 0 598 701 | 5/1994 | |
| JP | 8-336984 A | * 12/1996 | ..... B41J/2/175 |
| JP | 9-11502 | 1/1997 | |

* cited by examiner

*Primary Examiner*—Michael Nghiem
(74) *Attorney, Agent, or Firm*—Fitzpatrick, Cella, Harper & Scinto

(57) ABSTRACT

An ink jet recording apparatus which performs recovery process for recording device by a recovery system having capping device being closely in contact with or parting from recording device installed on a head installation unit for recording by discharging ink to a recording medium. For this recording apparatus, the cap of the recovery system is made controllable so that the cap can be at a first position where it is in close contact with the recording head, and at a second position where the recording sheet is made conveyable. Then, when recording data is transferred, the cap and a movable platen is allowed to shift from the first position to the second position so as to make recording possible. When the recording operation terminates, the cap and the movable platen shifts from the second position to the first position so as to enable it to return to the capping status. With the structure thus arranged, it becomes possible to reduce the dimension of the apparatus main body in the carriage traveling direction by the widthwise dimension of a recovery system irrespective of the size of the recovery system without inviting any increase of a load given to the carriage motor.

22 Claims, 23 Drawing Sheets

| FIG. 13A |
| --- |
| FIG. 13B |

| FIG. 16A |
| --- |
| FIG. 16B |

CAPPING OF INK JET RECORDING HEAD

BACKGROUND OF THE INVENTION

1. Field of the Invention

The present invention relates to an ink jet recording apparatus for recording by discharging ink from recording means mounted on a carriage to a recording medium.

2. Related Background Art

The recording apparatus, which is provided with such function as a printer, a copying machine, a facsimile, or the recording apparatus, which is used as an output device for a complex electronic apparatus that includes a computer, a word processor, or a work station, among some others, is the one that records images (including characters, symbols, and the like) on a recording medium (a recording material) such as paper, cloth, plastic sheet, or OHP sheet.

On these apparatuses, an ink jet type recording apparatus (an ink jet recording apparatus) performs recording by discharging ink from recording means (a recording head) to a recording medium, which facilitates making recording means compact, and also, makes it possible to record images in high precision at high speed on an ordinary paper sheet without any particular treatment given thereto. There are also advantages, among some others, that its running cost is lower; being of non-impact type, it can operate with a lesser amount of noises; and by use of many kinds of ink (color ink, for instance) it can record color images with ease.

As the energy generating element for generating energy utilized for discharging ink from the discharge ports of an ink jet recording head, there is the one that uses electromechanical converting elements, such as piezo elements; the one that discharges ink droplets by the activation of heat generated by the irradiation of electromagnetic waves, such as laser; or the one that heats liquid by use of electrothermal converting elements each provided with heat generating resistive device. Of these means, the ink jet type recording means (the recording head), which discharges ink as ink droplets by the utilization of thermal energy, makes it possible to arrange discharge ports in high density for recording in high resolution. Particularly, among them, the recording head that uses electrothermal converting elements as energy generating devices makes it easier to miniaturize the head, and also, makes it possible to fully utilize the advantages of the IC technologies and micromachining techniques, which have shown remarkable progress of art and reliability in the semiconductor field in recent years. A recording head of the kind has, therefore, an advantage, among many others, that a highly precise assembling is possible with ease at lower costs of manufacture.

Meanwhile, there are various demands as to the materials of recording medium to be used. In recent years, developments have been made to meet these demands. Then, the recording apparatus is now made capable of using such recording medium as cloth, leather, non-woven fabric, or each metal, besides paper (including thin paper sheet, processed sheet) or thin resin plate (OHP or the like).

For the ink jet recording apparatus of serial type where recording is made with the main scanning in the direction orthogonal to the carrying direction of a recording sheet (recording medium), images (including characters, symbols, and the like) are recorded by the recording head which is mounted on a carriage to travel along the recording sheet after the recording sheet has been set at the predetermined recording position, as well as by the execution of sheet feeding in a predetermined amount (sub-scanning), hence forming images on the recording medium. FIG. 20 is a perspective view which shows the conventional example of an ink jet recording apparatus that forms images by use of recording means that scans on a recording medium relatively. In FIG. 20, a reference numeral 101 designates recording means (a recording head) which performs recording by discharging ink; 102, the carriage mounting the recording head thereon, which travels in the direction at right angles to the sheet feeding direction (carrying direction) of the recording medium (recording sheet); and 103 and 104, the guide shaft and auxiliary rail, which support the reciprocation of the carriage 102.

In FIG. 20, a reference numeral 105 designates a carriage motor for driving the carriage; 106, a driving pulley direction connected with the carriage motor; 107, an idler pulley arranged to face the driving pulley 106; 108, a timing belt tensioned around the driving pulley 106 and the idler pulley 107 to transmit the driving power of the carriage motor 105 to the carriage 102; 109, a carrying motor (sheet feeding motor) for carrying (feeding) a recording sheet 110; 111, a cap to protect the discharge port surface of the recording head 101 from being dried at the time of non-recording; 112, a carrier roller for carrying (feeding) the recording sheet 110; and 113, a pre-discharge receptacle for receiving ink (pre-discharge ink or the like) discharged from the recording head 101 for the other operations than recording, which is positioned between the cap 111 and the recording sheet 110.

In FIG. 20, there is arranged a pressure roller 114 for providing the carrying power for the recording sheet 110 by pressing it to the carrying roller 112 by use of biasing means which is not shown. Then, in the vicinity of the aforesaid pre-discharge receptacle 113, a wiping member (not shown) is arranged to wipe off ink or the like adhering to the discharge port surface, which may impede appropriate ink discharges. This wiping member is usually formed by an elastic plate member such as rubber. Also, a double-arrow mark 115 indicates the directions in which the carriage 102 reciprocates (main scanning direction), and an arrow mark 116 indicates the rotational direction of the carrying roller 112 at the time of recording.

The operation of the ink jet recording apparatus shown in FIG. 20 is as follows: when a recording operation begins, the cap 111, which is closely in contact with the recording head for protecting the discharge ports of the recording head 101, is separated from the recording head. Then, the driving power of the carriage motor 105 is transmitted to the carriage 102 through the timing belt 108 tensioned around the driving pulley 106 and the idler pulley 107. In this manner, the traveling direction and position of the carriage 102 are controlled.

The recording head 101 travels above the surface of the recording sheet 110 together with the carriage 102 in a predetermined distance, and then, reverses the traveling direction towards the cap 111 (toward the original capping position). This operation is repeated to perform reciprocation in the directions indicated by the double-arrow mark 115. In synchronism with this traveling of carriage 102, the recording head 101 is driven in accordance with recording information. Ink droplets are discharged (to fly and adhere) to specific positions on the recording sheet 110 for recording images per one-line portion continuously. The recording sheet 110 is carried in a predetermined length by rotating the carrying roller 112 in a predetermined amount in the direction indicated by an arrow 116 by use of the sheet feeding motor 109 per completion of main scanning of recording head 101. By repeating these operations, recording is performed for the recording sheet 110.

The pre-discharge receptacle 113 is arranged at a position outside the predetermined position (recording area) of the recording sheet 110, which is between the cap 111 and the recording sheet 110, for-example. As a result, in order to execute pre-discharge, the recording head 101 should move to the position of the pre-discharge receptacle 113 by means of the main scanning of the carriage 102. Then the pre-discharge should be executed in a state where the recording head is stationary at the position of the pre-discharge receptacle 113. Here, it may be possible to use the aforesaid cap 111 in place of the pre-discharge receptacle 113.

Also, in order to maintain the normal recording operation, there is a need for wiping off ink, ink mist, or other dust particles adhering to the discharge port surface of the recording head 101 per passage of predetermined time or at a timing subsequent to having executed pre-discharge or the like. Therefore, a wiping member (not shown) is provided for wiping off to clean the discharge port surface of the recording head 101. Usually, the wiping operation is executed about once per one recording sheet.

FIG. 21 is a vertically sectional view which schematically shows the state where the cap 111 is closely in contact with the discharge port surface 117 of the recording head 101. In FIG. 21, the cap 111 is formed by an elastic material such as rubber, and the circumferential portion 118 thereof is in the form of ribs. Thus, when pressed to the discharge port surface 117, the rib portions are compressed to be elastically deformed only to the height designated by a reference numeral 119 so that the cap is in contact (closely) with the discharge port surface 117 without a gap. Also, the cap 111 is connected with a recovery system (suction pump and others) which is not shown and a waste ink absorbent through the tube 121 which is connected with through hole 120 arranged for the backside of the cap.

When the carriage 102 and the recording head 101 are at the home position, the cap 111 is pressed to be closely in contact with the discharge port surface 117 by use of a driving mechanism (not shown) comprising a recovery motor, a plurality of gears, and a magnetic clutch, thus eliminating the defective ink discharges that may be brought about by the dried ink or coagulated ink on the ink discharge unit or protecting the discharge port surface 117.

Also, in this state (of being capped), the air in the tube 121 is sucked in the direction indicated by an arrow 122 by driving a tube pump which is not shown. Then ink in the recording head 101 is sucked (sucked out) through the cap 111 and the tube 121, and at the same time, ink is replenished afresh from an ink tank into the recording head 101. In this manner, bubbles and overly viscous ink in the recording head 101 are removed. After the recovery process of the recording head 101 has been completed, the cap 111 is allowed to part from the discharge port surface 117 by means of the aforesaid driving mechanism, hence making it possible to shift the carriage 102 and the recording head 101 in the main scanning direction (the direction perpendicular to the surface of FIG. 21) to initiate recording operation.

In recent years, portability is also required for a recording apparatus, such as a printer. For a note type small printer, in particular, it has been demanded increasingly more to make the printer lighter and smaller. However, for the conventional ink jet recording apparatus as described above, the cap 111, the pre-discharge receptacle 113, and others required for the formation of the recovery system are all arranged outside the recording area as shown in FIG. 20. Further, then, the dimension of the apparatus main body in the traveling direction of carriage is substantially determined by the width of a recording sheet plus that of the recovery system. Therefore, in order to reduce the widthwise dimension of the recording apparatus in the carriage traveling direction, it is required to make the recovery system itself smaller (that is, the constituents of the recovery system should be curtailed and miniaturized). However, there is automatically a limit to making the recovery system itself smaller, and it has been almost impossible to attempt the reduction of the widthwise dimension thereof. For a method of solving a problem of the kind, a proposal has been made as disclosed in Japanese Patent Application Laid-Open No. 9-11502 that a carriage and a recovery system are integrally formed as one body, and driven in the main scanning direction. With this method, however, load to the carriage motor becomes greater to the extent that the recovery system and the carriage are integrally formed or there is a drawback that the dead space becomes greater due to the integral structure thereof.

SUMMARY OF THE INVENTION

In consideration of the problems encountered in the conventional art as discussed above, the present invention is designed. It is an object of the invention to provide an ink jet recording apparatus for which the dimension of the apparatus main body in the carriage traveling direction is made significantly smaller neither inviting the increase of load given to the carriage motor dead space nor inviting the increase of the dead space irrespective of the size of the recovery system.

It is another object of the invention to provide an ink jet recording apparatus provided with control means for optimizing the relative movements of the recording head installation unit and recovery means, and the conveyance of a recording medium as well.

BRIEF DESCRIPTION OF THE DRAWINGS

FIG. 3A shows the state where the electric supply source is turned off or on standby; and FIG. 3B shows the state where recording is performed.

DETAILED DESCRIPTION OF THE PREFERRED EMBODIMENTS

Hereinafter, with reference to the accompanying drawings, the description will be made of the embodiments in accordance with the present invention. In this respect, the same reference marks indicate the same or corresponding parts in each of the drawings.

First Embodiment

Figure 1:
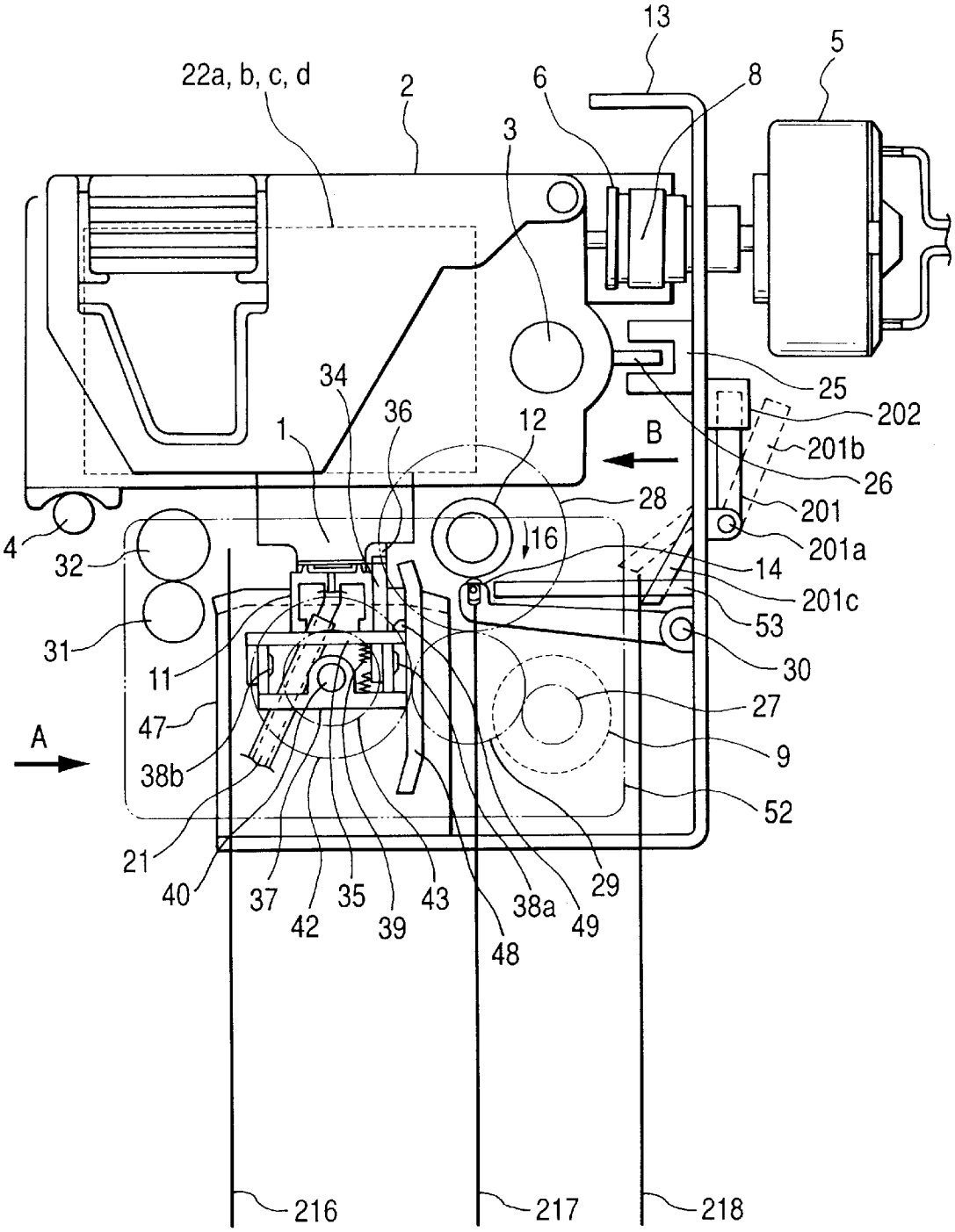
FIG. 1 is a side view which shows the principal structure of an ink jet recording apparatus, for which the present invention is applicable, in a state where the electric supply source is turned off or on the standby in accordance with a first embodiment of the invention.
Figure 2:
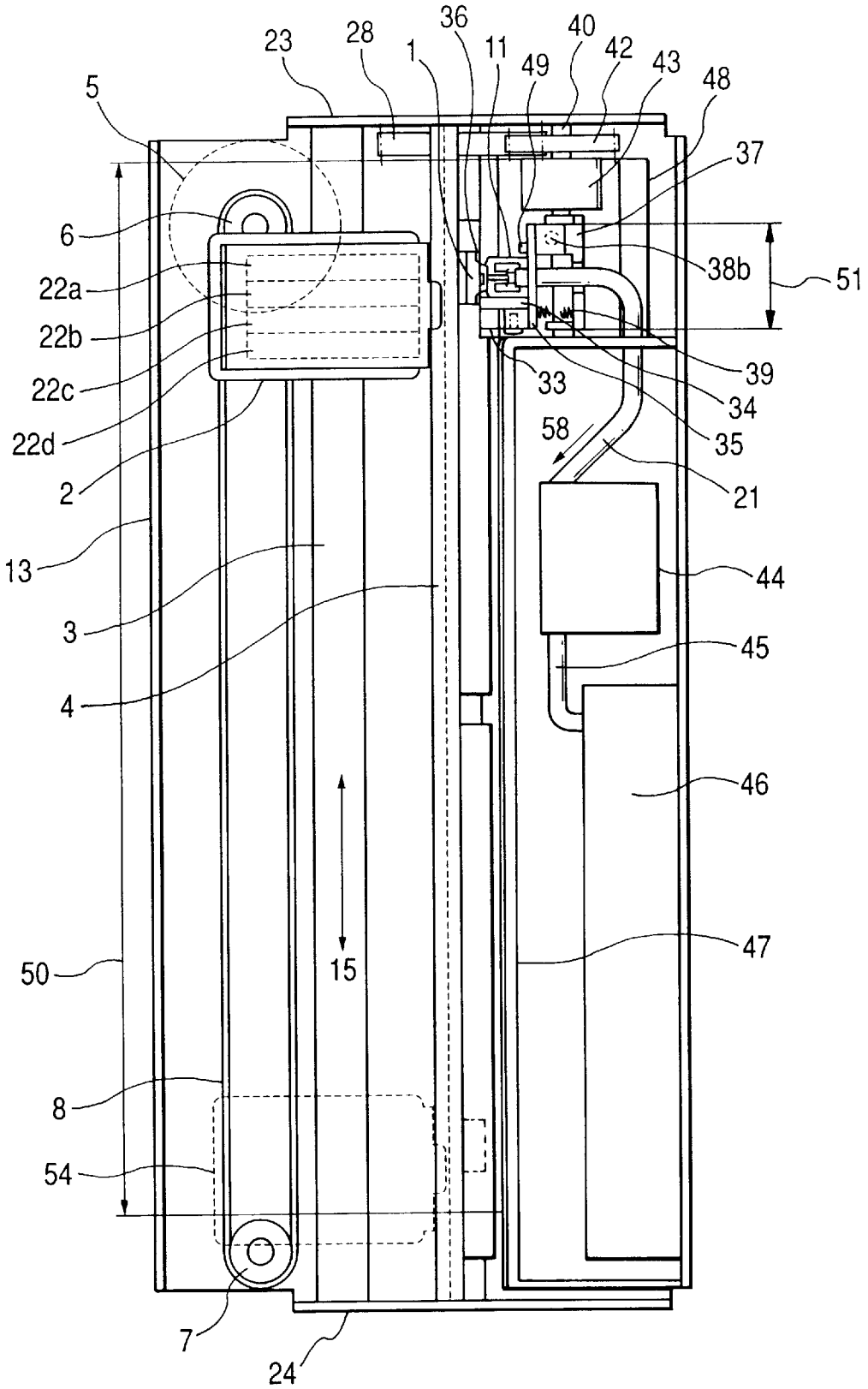
FIG. 2 is a front view which is observed in the direction indicated by an arrow A in FIG. 1.
Figure 3A:
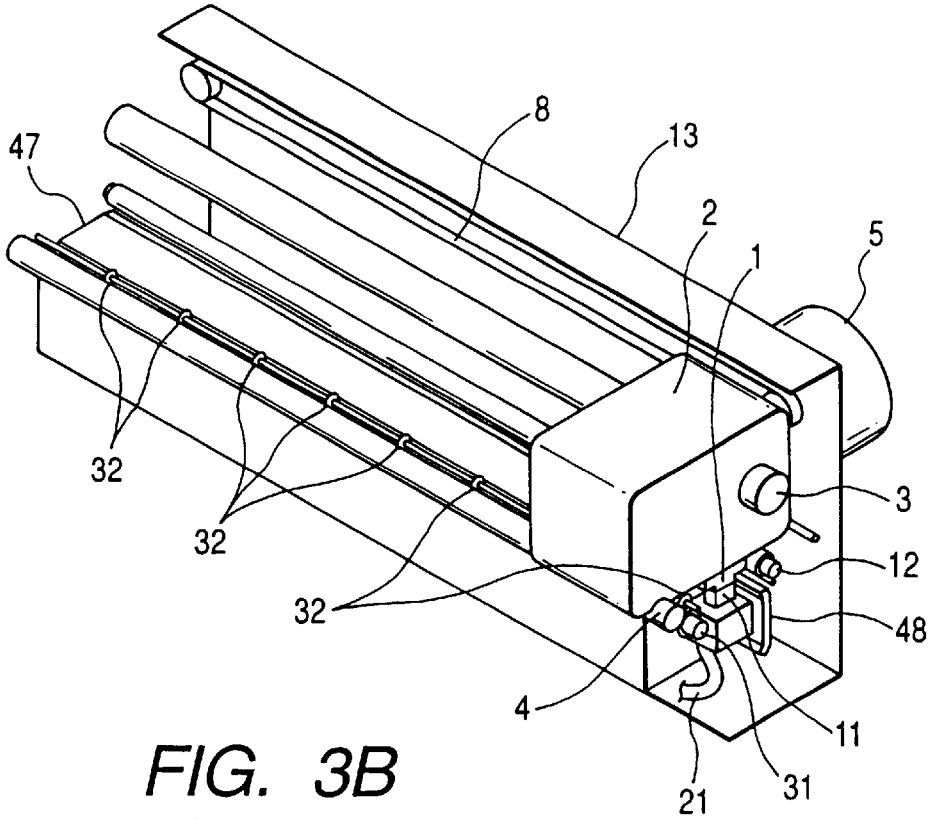
FIGS. 3A and 3B are perspective views which schematically illustrate the ink jet recording apparatus shown in FIG. 1.
Figure 3B:
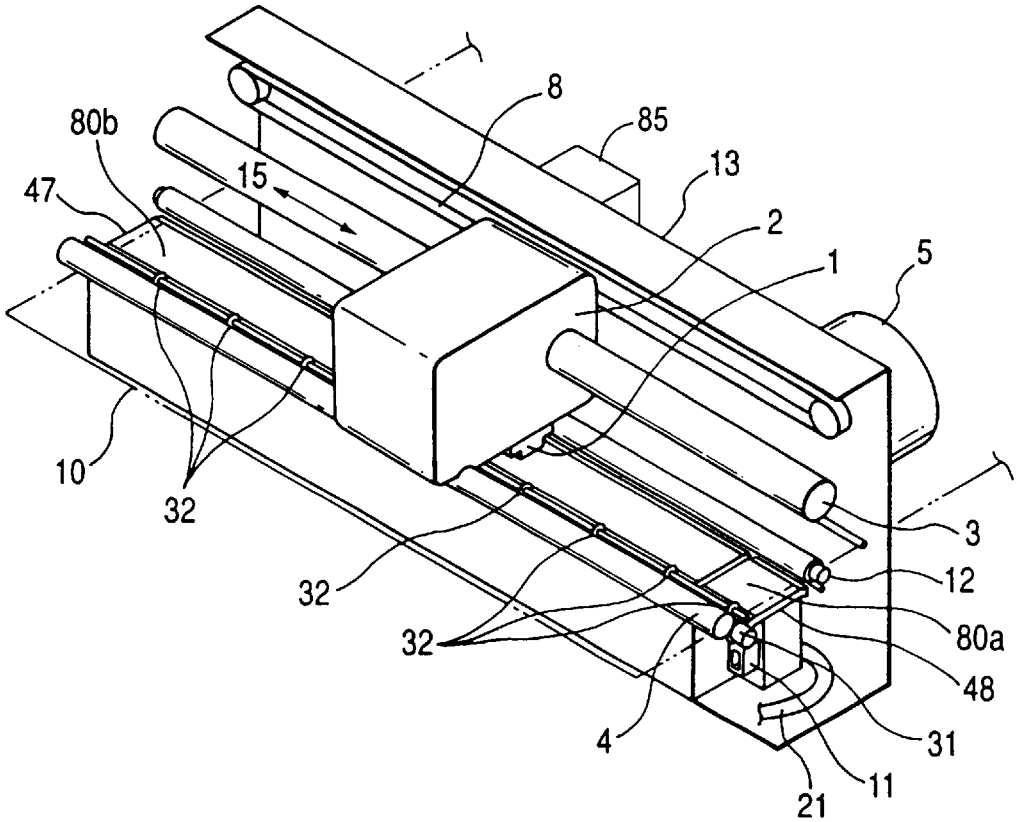

FIG. 1 is a side view which shows the principal structure of an ink jet recording apparatus, for which the present invention is applicable, in a state where the electric supply source is turned off or on the standby in accordance with a first embodiment of the invention. FIG. 2 is a front view which is observed in the direction indicated by an arrow A in FIG. 1. FIGS. 3A and 3B are perspective views which schematically illustrate the ink jet recording apparatus shown in FIG. 1; FIG. 3A shows the state where the electric supply source is turned off or on standby; and FIG. 3B shows the state where recording is performed.

In FIG. 1, FIG. 2, and FIGS. 3A and 3B, a reference numeral 13 designates chassis for keeping the rigidity of the apparatus main body, and for supporting each kinds of constituents at the same time; 1, recording means (recording head) for recording by discharging ink; 22*a*, 22*b*, 22*c*, and 22*d*, the ink tanks each retaining different kinds of ink, Bk (black), Y (yellow), M (magenta), and C (cyan), respectively; 2, the carriage that functions as a recording head installation unit, and moves in the main scanning direction, while holding (mounting) the recording head 1, and the ink tanks 22*a* to 22*d*; 3 and 4, the carriage rail and auxiliary rail which are fixed to both side faces 23 and 24 (see FIG. 2) of the chassis 13 by means of E ring or the like (not shown), respectively, for supporting and guiding the carriage 2 to reciprocate.

A reference numeral 5 designates a carriage motor that drives the carriage 2, and the carriage motor 5 is fixed to the chassis 13 through a fixing plate (not shown); 6, a driving pulley directly connected with the carriage motor 5; 7, an idler pulley (see FIG. 2) arranged on the apparatus main body side opposite to the driving pulley 6; and 8, a carriage belt which is tensioned around the driving pulley 6 and the idler pulley 7 to transmit the driving power of the carriage motor 5 to the carriage 2. Control unit 85 is also shown in FIG. 3B and is a controller for controlling the operations of the ink jet recording apparatus.

In FIG. 1, a reference numeral 9 designates a carrying motor (sheet feeding motor) which serves as the driving power source to carry (feed) a recording medium (recording sheet) 10 (see FIGS. 3A and 3B), and the carrying motor 9 is installed on the side face 23 of the chassis 13 (see FIG. 2). In FIG. 1, a reference numeral 27 designates a motor gear which is pressed onto the output shaft of the sheet feeding motor 9; 12, a carrying roller for carrying the recording sheet 10; 28, a carrying roller gear which is pressed onto the edge portion of the carrying roller 12; 29, a relay gear that transmits the output of the sheet feeding motor 9 from the motor gear 27 to the carrying roller gear 28; 14, a pressure roller to bias the recording sheet 10 in the direction toward the carrying roller 12, and the pressure roller 14 is rotatively and axially supported centering on the fulcrum 30, and also, biased in the direction toward the carrying roller 12 by the twisted coil spring which is not shown; 31, a sheet exit roller that carries the recording sheet 10 in the exit direction, and the exit roller 31 is driven through the carrying roller gear 28 by use of driving transmission means, which is not shown; and 32, sheet exit spur which rotates following the sheet exit roller 31.

The double-arrow mark 15 in FIG. 2 indicates the directions of reciprocation of the carriage 2, and the arrow mark 16 in FIG. 1 indicates the rotational direction of the carrying roller 12 at the time of recording. In FIG. 1, a reference numeral 53 designates a sheet guide that leads the recording sheet 10, which is fed from the right side in FIG. 1, between the carrying roller 12 and the pressure roller 14; 201, a sheet edge detection flag supported rotatively by the shaft portion 201*a* of the chassis 13; and 202, a photo-interrupter fixed to the chassis 13. The sheet edge detection flag 201 is biased by the twisted coil spring (not shown) to the rotational direction centering on the shaft portion 201*a* as the fulcrum thereof. In other words, the sheet edge detection flag 201 cuts off the light emitting portion of the photointerrupter 202 with one end portion 201*b* of the sheet detection flag 201 as shown in FIG. 1 when no recording sheet is carried, and at the same time, the sheet edge detection flag 201 is biased by the twisted coil spring (not shown) so that the other edge portion 201*c* thereof is positioned on the lower side of the sheet passage plane of the sheet guide 53. The sheet guide 53 has a continuous plate in the widthwise direction of the recording sheet 10. However, a cut off portion is formed therefore in the area where the other edge portion 201*c* of the sheet edge detection flat 201 is allowed to rotate.

In FIG. 1 and FIG. 2, a reference numeral 25 designates the home position sensor formed by the photointerrupter fixed to the chassis 13; 26, the sensor flag which is provided for the carriage 2, and when this sensor flag 26 cuts off the light emitting portion of the home position sensor 25, the home position is detected for the carriage 2 and the recording head 1. As shown in FIG. 2, the recording area 50 also exists on the carrying roller gear 28 side beyond the capping position of the carriage 2, that is, on the outer side (the upper side in FIG. 2) of the capping position of the apparatus main body. As a result, the reversing position of the carriage 2 in the traveling direction at the time of recording is of course on the carrying roller gear 28 side beyond the capping position, that is, the outer side (the upper side in FIG. 2) of the capping position of the apparatus main body. Also, the home position sensor 25 is arranged between the capping position of the carriage 2 (the recording head 1) and the reversing position of the carriage 2 in the traveling direction described above.

In FIG. 1 and FIG. 2, a cap 11 is arranged at the capping position described above. The cap 11 closes the ink discharge port unit of the recording head 1 when recording is not in operation so as to prevent the discharge ports from being dried, as well as to protect the discharge port surface. The cap is formed by an elastic material such as rubber. In the vicinity of the cap 11, a wiping member 33 (see FIG. 2) is arranged. The wiping member 33 wipes off ink and other particles adhering to the discharge port surface that may impede appropriate ink discharges. Here, a reference numeral 34 designates a retractive cam which is arranged to prevent the discharge port surface of the recording head (recording means) 1 from being rubbed by the cap 11 unexpectedly; 35, a cap base, and on this cap base 35, the cap 11, the wiping member 33, and the retractive cam 34 are fixed. For the recording head 1, a cam follower 36 is formed to face the retractive cam 34. For the wiping member 33, is formed a plate member of elastic material such as rubber.

In FIG. 1 and FIG. 2, a reference numeral 37 designates the rotation base that rotatively supports the shafts 38*a* and 38*b* of a cap base 35; 39, a coil spring that biases the cap base 35 rotatively supported by the rotation base 37 in the direction toward the recording head 1; 40, the rotational shaft both ends of which are supported by the side face 23 of the chassis 13 and a first platen 47 to be described later; 42, a rotational gear which is fixed to an input shaft (not shown) and engages with the relay gear 29 described earlier; 43, an electromagnetic clutch. The electro-magnetic clutch 43 has the rotational shaft 40 as the output shaft to which the rotation base 37 is fixed. In the on-condition, the input shaft and the rotational shaft 40 are connected to transmit input form the rotational gear 42 to the rational shaft 40, thus enabling the rotation base 37, the cap base 35, the cap 11, and the like, which are installed thereon, to be rotated. Here, a reference numeral 21 designates a recovery tube through which ink runs at the time of recovery operation, and one end of the recovery tube 21 is connected with the interior of the cap 11, and the other end thereof is connected with a recovery pump 44; 45, a waste ink tube, and one end of the waste ink tube 45 is connected with the recovery pump 44, and the other end thereof is connected with a waste ink absorbent 46.

In FIG. 1 and FIGS. 3A and 3B, a reference numeral 47 designates the first platen that faces the recording head 1; 48, the second platen that faces the recording head 1 at the time of recording. The first platen 47 is fixed to the chaises 13 by use of fixing means which is not shown so that it faces the recording head 1 at the time of recording. The second platen 48 is fixed to the aforesaid rotation base 37 by use of fixing means which is not shown or it is formed integrally with the rotation base 37, and at the time of recording, it faces the recording head 1, but the structure is arranged so that it can be retracted below the sheet passage plane by rotating together with the rotation base 37 at the non-recording time. Also, the upper limit of the cap base 35, which is biased by means of the coil spring 39 in FIG. 1, is regulated by the stopper 49 which is formed on the reverse side of the said platen 48.

In FIG. 2, a reference numeral 50 designates the maximum sheet passage width of the recording apparatus hereof for the recording medium (recording sheet) 10; 51, the width of the cap base 35. As shown in FIG. 2, since the cap 11 and the circumferential portion (portion near to the cap) are arranged within a range of the sheet passage area 50, the widthwise dimension of the recording apparatus can be made smaller substantially by the same dimension of the width 51 of the cap base 35, hence making it possible to attempt making the recording apparatus smaller and lighter accordingly.

The aforesaid recording means (recording head) 1 is an ink jet recording head for recording discharging ink from a plurality of discharge ports selectively when energy is applied in accordance with recording signals. Also, the recording head 1 is ink jet recording means for discharging ink by utilization of thermal energy, which is provided with electrothermal converting elements for generating thermal energy. Further, the recording head 1 discharges ink from the discharge ports for recording by the utilization of pressure changes caused by the growth and shrinkage of bubbles caused by film boiling generated by the thermal energy applied by the electrothermal converting elements. The electrothermal converting elements are provided for each of the discharge ports, respectively, to discharge ink from the corresponding discharge ports by the application of pulse voltage to the respective electrothermal converting elements in accordance with recording signals.

Figure 19:
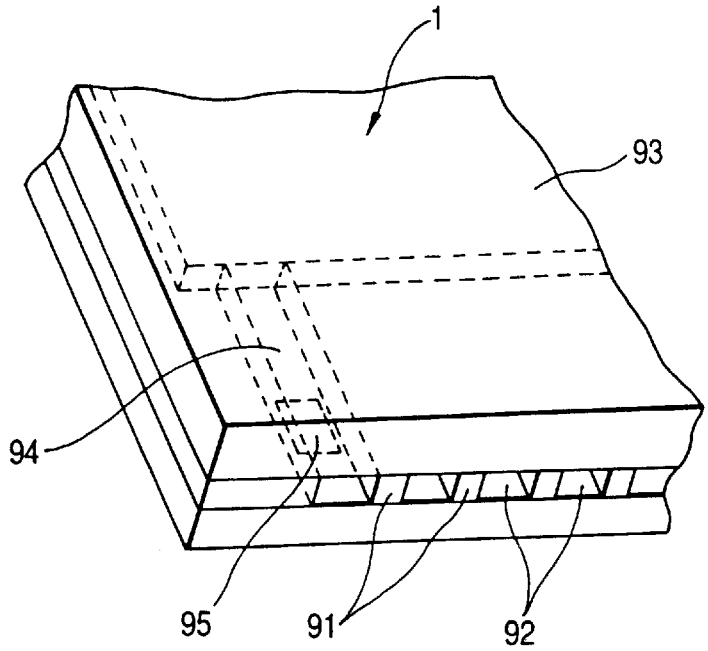
FIG. 19 is a partially perspective view which schematically shows the structure of the ink discharge portion of recording means represented in FIG. 1.

FIG. 19 is a partially perspective view which schematically shows the structure of the ink discharge portion (one discharge port array) of recording means (recording head, head cartridge) 1. In FIG. 19, a plurality of discharge ports 92 are formed at the predetermined pitches on the discharge port surface 91 that faces a recording medium (recording sheet or some other recording material) with a specific gap (0.3 to 2.0 mm approximately, for instance), and along the wall faces of each liquid flow path 94 communicated with a liquid chamber (common liquid chamber) 93 and each of the discharge ports 92, the electrothermal converting element (heat generating resistive member and others) 95 is arranged to generate energy for use of ink discharges.

For the present embodiment, the recording head 1 is supported by the carriage 2 in a positional relationship where the discharge ports 92 are arranged in the direction intersecting with the direction of main scan traveling (the traveling direction of the carriage 2). In this way, each of the electrothermal converting elements 95 is driven (by the application of pulse voltage) in accordance with image signals or discharge signals. Thus, the recording means (recording head) 1 is structured to give film boiling to ink in each of the liquid paths 94, and by the pressure thus exerted, ink droplets are discharged from the corresponding discharge ports 92 for recording.

Figure 12A:
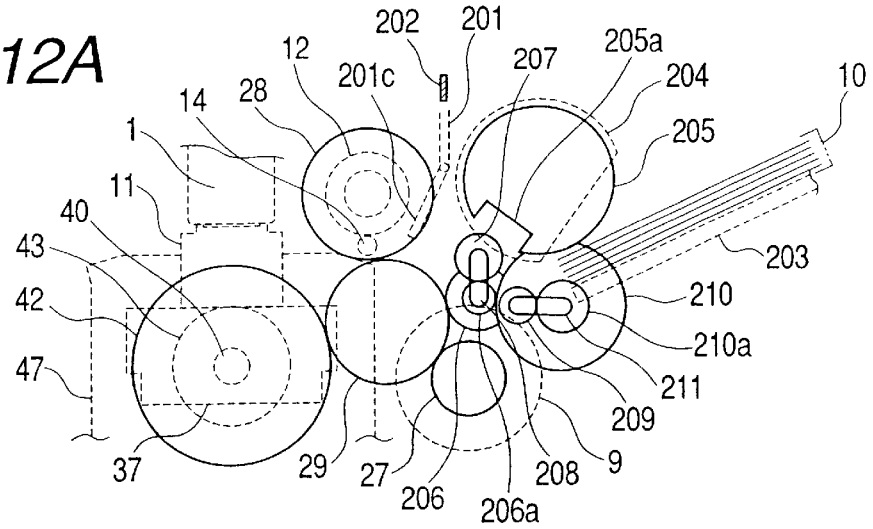
FIGS. 12A, 12B, and 12C are views which illustrate schematically the driving power transmission system and the feeding operation of a recording medium for the ink jet recording apparatus to which the present invention is applicable in accordance with the first embodiment thereof.
Figure 12B:
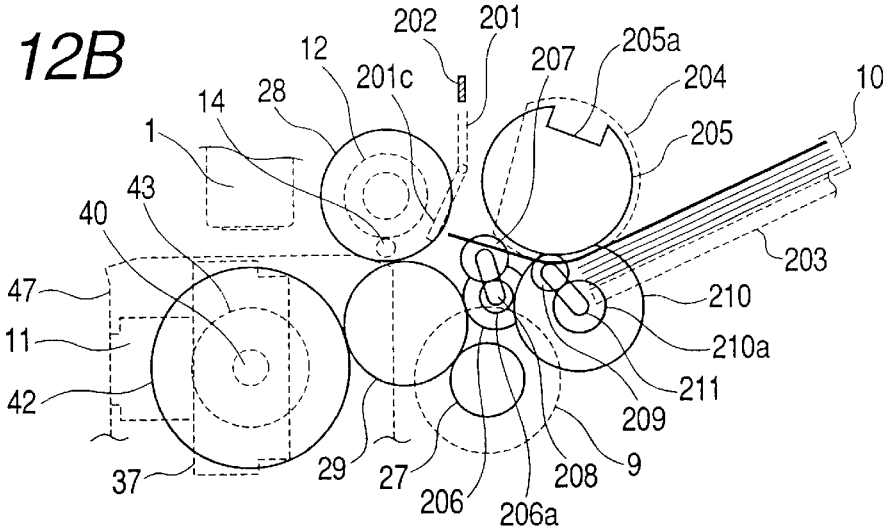
Figure 12C:
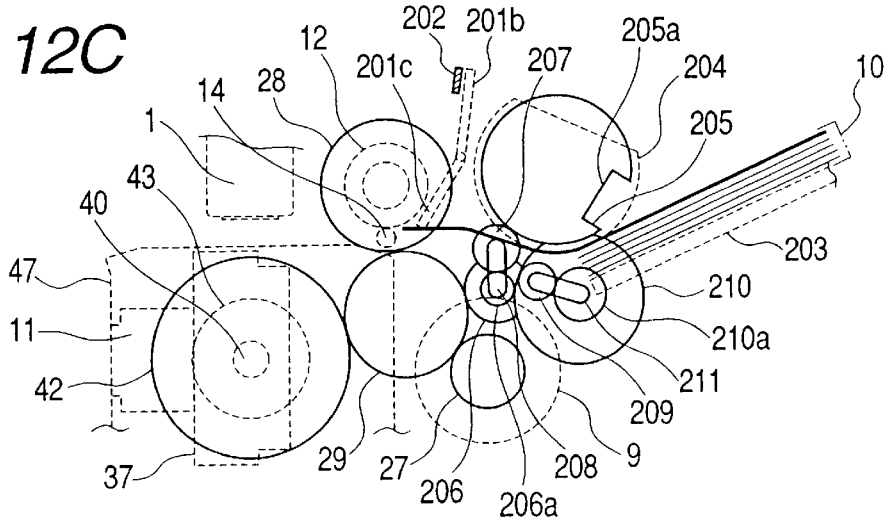

FIGS. 12A to 12C are views which schematically illustrate the driving transmission system and the feeding operation of a recording medium of the ink jet recording apparatus, to which the present invention is applicable, in accordance with the first embodiment thereof. In FIGS. 12A to 12C, in order to illustrate the operation of the driving transmission system and sheet feeding system, the pitch circle of each gear and the recording sheet 10 are indicated by solid lines, while the other structural portions are indicated by dotted lines. In FIGS. 12A to 12C, a reference numeral 203 designates a tray on which plural sheets of recording sheet 10 are stacked; 204, a pickup roller (PU roller), and the pickup roller 204 has a sectional configuration where a part of circle is cut off, and one of plural recording sheets 10 stacked on the tray 203, which is on the uppermost layer, is picked up to be fed to the recording unit; 205, the pickup roller gear which is fixed to end portion of the PU roller (pickup roller) 204, and a part of the pickup roller gear (PU gear) 205 is provided with a toothless portion 205*a*.

A reference numeral 206 designates a sheet feeding gear which engages with the relay gear 29; 207, a swinging gear which engages with the sheet feeding gear 206; 208, a swinging arm that rotatively supports the sheet feeding gear 206 and the swinging gear 207; 209, a pickup swinging gear (hereinafter referred to as a PU swinging gear); and 210, a second sheet feeding gear. Then, the small gear 210*a* on the inner side of the second sheet feeding gear 210 is rotatively supported through a second swinging arm 211, while keeping the engagement with the PU swinging gear 209, which will be described later.

Figure 4:
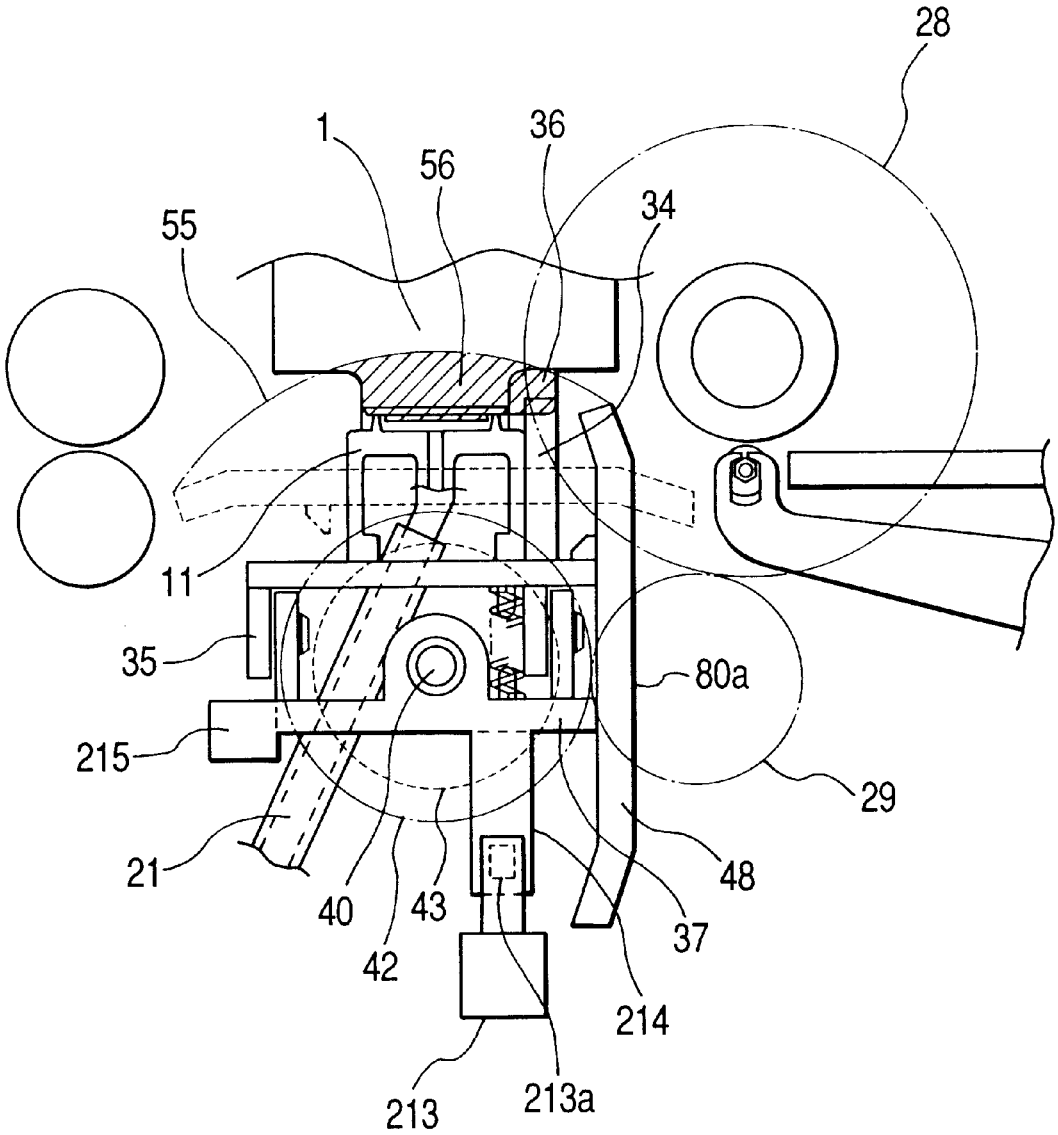
FIG. 4 is a partially enlarged side view which shows the state of capping means being at a first position by enlarging the portion of range at 52 in FIG. 1.

FIG. 4 is a partially enlarged side view which shows the portion in the range 52 in FIG. 1 in enlargement. Now, with reference to FIG. 1, FIG. 2, FIGS. 3A and 3B, FIG. 4, and FIGS. 12A, to 12C, the operation of the ink jet recording apparatus will be described in accordance with the present invention. In this respect, FIG. 4 shows the state of the electric supply source being off or on standby as in FIG. 1, where the recording head 1 is airtightly closed by the cap 11. The position of the cap 11 in this state is defined as a first position. When recording data are transferred from a computer or the like to the recording apparatus, the carriage 2 moves in the scanning direction, and it is on standby at a position arbitrarily set. When the carriage 2 begins to move, the output of the home position sensor (HP sensor) 25 is invalidated until the termination of recording by use of control means which is not shown, irrespective of the positions of the sensor flag 26 for use of home position detection. At this juncture, the discharge port surface 91 of the recording head 1 is regulated by the retractive cam 34 and follower 36 so as not to be rubbed with the cap 11 (details will be described later).

Now, with reference to FIGS. 12A and 12B, the sheet feeding operation will be described. FIG. 12A shows the state before the recording sheet 10 is fed. FIG. 12B shows the state where the recording sheet 10 is being fed, but the leading edge of recording sheet is yet to be detected. In FIG. 12A, the swinging gear 207 faces the toothless portion 205*a* of the PU gear 205. The PU swinging gear 209 is away from the PU gear 205. Here, with a sheet feed command, the sheet feeding motor 9 is driven in the counterclockwise direction, thus operating by use of the motor gear 27 to rotate the sheet feeding gear 206 also in the counterclockwise direction by way of the relay gear 29 in order to make a sheet feeding possible as shown in FIG. 12B.

In other words, when the sheet feeding gear 206 rotates in the counterclockwise direction by use of the motor gear 27 through the relay gear 29, the swinging gear 207 rotates in the counterclockwise direction by means of the swinging arm 208 with the center of the sheet feed gear 206 as fulcrum, thus parting it from the PU gear 205. The second sheet feeding gear 210, which engages with the small gear 206*a* of the sheet feeding gear 206, is allowed to rotate in the clockwise direction. Also, while rotating in the counterclockwise direction, the PU swinging gear 209, which engages with the small gear 210*a*, rotates in the clockwise direction by means of the second swinging arm 211 toward the PU gear 205 with the center of the small gear 210*a* as fulcrum. In this way, the status becomes as shown in FIG. 12B. When the PU swinging gear 209 is allowed to engage with the PU gear 205 as shown in FIG. 12B, the PU gear 205 and PU roller 204 are driven to rotate in the clockwise direction to feed one sheet on the uppermost layer of recording mediums 10 stacked on the tray 203.

Figure 5:
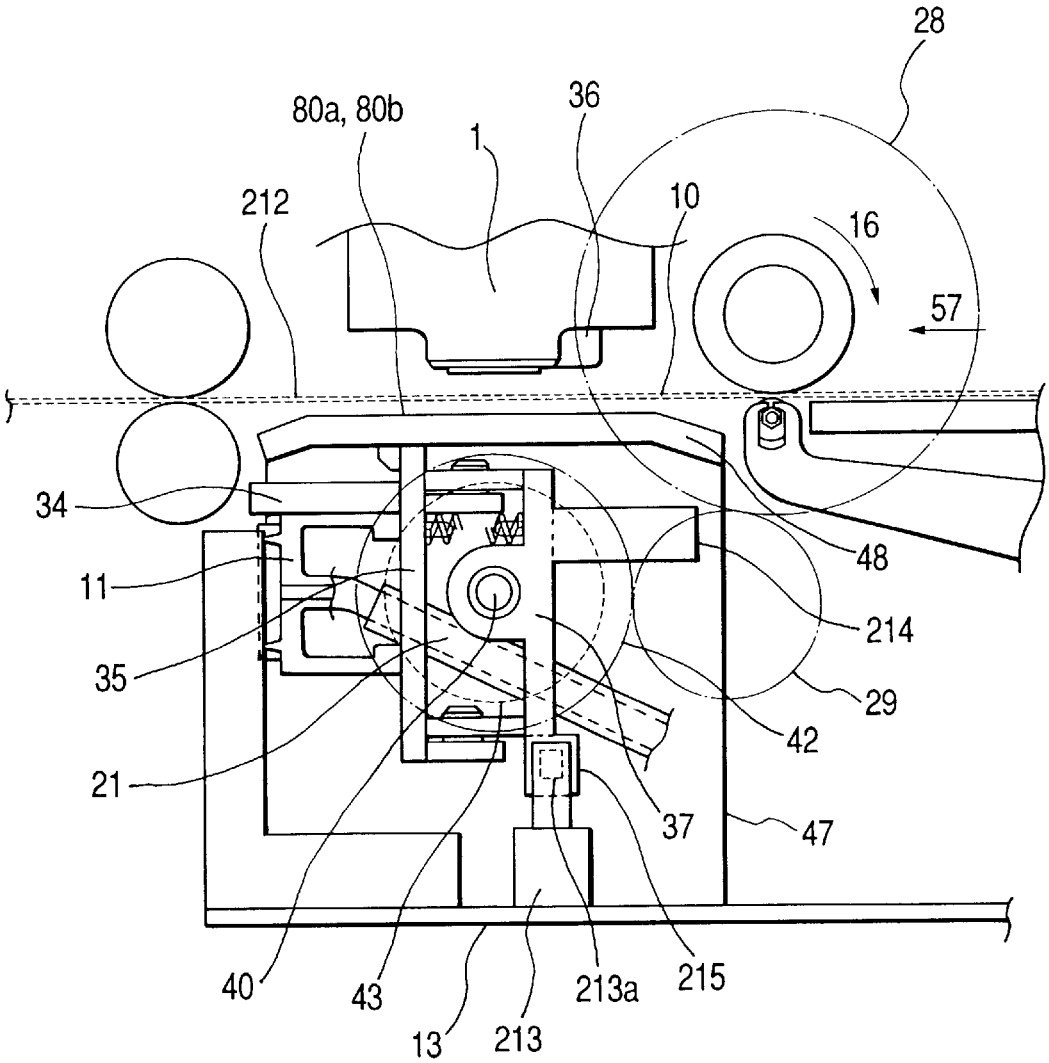
FIG. 5 is a partial side view which shows the state of capping means being at a second position where a recording medium is made passable.

FIG. 4 is a partial side view which shows the status of capping means 11 being at the first position where it is closely in contact with recording means 1. FIG. 5 is a partial side view which shows the status of capping means 11 being at the second position where a recording medium is made passable. Now, with reference to FIG. 1, FIGS. 3A and 3B, FIG. 4, and FIG. 5, the description will be made of the operation of the recovery system of the ink jet recording apparatus, to which the present invention is applicable, in accordance with the first embodiment thereof. In FIG. 4 and FIG. 5, reference numerals 213 and 213*a* designate the photointerrupter and light receiving and emitting units thereof, which are fixed to the chassis 13; 214 and 215, the respective flags fixed to the rotation base 37, and the flag 214 is positioned to cut off light of the light receiving and emitting unit 213*a* in the state shown in FIG. 4 (at the first position of the cap 11), while the flag 215 is positioned to cut off light of the light receiving and emitting unit 213*a* in the state shown in FIG. 5 (at the second position of the cap 11).

With the initiation of driving the sheet feeding motor 9, the electromagnetic clutch 43 is turned on to connect the rotational gear 42, the rotational shaft 40, and the rotation base 37 are connected to transmit the driving power to the rotational shaft 40 through the relay gear 29 and the rotational gear 42. Then, the rotation base 37, and the cap base 35, the cap 11, and the like, which are fixed thereto, are allowed to rotate in the counterclockwise direction from the state shown in FIG. 4 (the same as each state shown in FIG. 1, FIG. 2, and FIG. 3A). With this rotation, the flag 214 passes out from the gap between the light receiving and emitting unit 213*a*, and as shown in FIG. 5 and FIG. 3B, the second platen 48 and the cap 11 are brought to the state where a recording medium can be carried (the second position where the recording sheet 10 is made passable). When this state is obtained to make the recording sheet passable, the flag 215 is ready to cut off light of the light receiving and emitting unit 213*a*, while the electromagnetic clutch 43 is in a state of being turned off. The broken lines 212 in FIG. 5 indicate the position of the recording sheet 10 when it is made passable.

The position of the cap 11 shown in FIG. 3B and FIG. 5 is the second position thereof. At this juncture, it is set as shown in FIG. 12B that the leading edge of the recording sheet 10 is allowed to reach only the position on the right side of the sheet edge detection flag 201*c* in FIG. 12B. In other words, the setting is arranged so that the leading edge of the recording sheet 10 reaches only in front of the sheet edge detection flat 201*c* as shown in FIG. 12B by means of the distance between the stacked position of the recording sheet 10 and the sheet edge detection flag 201*c*, the deceleration rate of the driving system from the motor gear 27 to the PU roller (pickup roller) 204, and the deceleration rate between the motor gear 27 to the rotational gear 42 by way of the relay gear 29 and the carrying roller gear 28. As a result, it becomes possible to prevent the leading edge of the recording sheet 10 from being inserted before the second platen 48 is ready to present the state shown in FIG. 3B and FIG. 5. There is, then, no possibility that the leading edge of the recording sheet rubs the discharge port surface 91 of the recording head 1 or the recording sheet 10 is stained, or further, such drawback as damaging the discharge port surface 91 is not allowed to ensue at all.

Also, even if the user pushes in a recording sheet 10 forcefully by some reason, for example, or even if the leading edge of a recording sheet 10 should reach the carrying roller 12 beyond the sheet edge detection flag 201*c* by being inserted manually for a manual sheet feeding stand (not shown), not from the tray 203 (see FIGS. 12A to 12C), before the cap 11 reaches the second position thereof, the sheet feeding motor 9 is driven to rotate in the counterclockwise direction during the rotation of the cap 11 in accordance with the present embodiment, and also, the carrying roller 12 is allowed to rotate in the counterclockwise direction through the relay gear 29. Then it is structured to carry the recording sheet 10 in the direction opposite to the one at the time of recording. As a result, the leading edge of the recording sheet 10 is caused to slip on the carrying roller 12, and stays as it is. The leading edge of the recording sheet 10 is not carried beyond the carrying roller 12 to rub the discharge port surface 91 of the recording head 1, or the recording sheet 10 is not caused to be stained, or such drawback as damaging the discharge port surface 91 is not caused to ensue at all. Also, in accordance with the present embodiment, the structure is arranged so that the setting detection means is formed by the sheet edge detection flag 201 in order to detect the setting of a recording medium for the recording unit when manually inserted for feeding.

Now, with reference to FIGS. 12A, 12B, and 12C, the description will be made of the structure and operation of the ink jet recording apparatus (first embodiment) in accordance with the present invention. The recording sheet is being carried even when the cap 11 rotates from the first position to the second position. Then, usually, with the detection of the arrival of the cap 11 at the second position as shown in FIG. 12B, the driving of the sheet feeding motor 9 is reversed to be in the clockwise direction. Thus, the rotation of the sheet feeding gear 206 is reversed to be in the clockwise direction to enable the second sheet feeding gear 210, which engages with the small gear 206*a*, to rotate in the counterclockwise direction. As a result, the PU swinging gear 209, which engages with the small gear 210*a*, rotates in the counterclockwise direction by means of the second swinging arm 211 with the center of the small gear 210*a* as fulcrum so that this gear no longer engages with the PU gear 205.

Then, the swinging gear 207 keeps its engagement with the small gear 206*a* of the sheet feeding gear 206, while rotating in the counterclockwise direction, and rotates by means of the swinging arm 208 in the direction toward the PU gear 205 with the center of the smaller gear 206*a* as fulcrum. Thus, as shown in FIG. 12C, this gear engages with the PU gear 205. As a result, The PU gear 205 and the PU roller 204 rotate in the clockwise direction continuously to carry the recording sheet 10 toward the recording head 1. FIG. 12C shows the state where the recording sheet 10 arrives at the edge portion 201*c* of the sheet edge detection flag 201, and then, the edge portion 201*b* of the sheet-edge detection flag 201 is in the state of being outside the light receiving and emitting unit of the photointerrupter 202. Also, the driving power transmission to the PU gear 205 shifts from the passage through the PU swinging gear 209 to the passage through the swinging gear 207. However, since the rotational direction of the PU gear 205 and the PU roller 204 does not change, the sheet feeding operation (the recording sheet 10 conveyance) is continued as it is. Also, the carrying roller 12 begins to rotate in the clockwise direction (sheet feeding direction).

After having detected the presence of the recording sheet 10 by use of the photointerrupter 202, the recording sheet is carried in a predetermined amount so that the leading edge of the recording sheet 10 reaches between the carrying roller 12 and the pressure roller 14. Then, with the swinging gear 207 arriving at the toothless portion (where no gear tooth is cut) 205*a* of the PU gear 205, the positional relations between each of gears presents a condition as shown in FIG. 12A. The driving power is no longer transmitted to the PU roller 204, thus carrying the recording sheet 10 by means of the carrying roller 12 and the pressure roller 14.

If the recording sheet 10 does not arrive at the edge portion 201*c* of the sheet edge detection flag even after a predetermined time elapses since the feeding of the recording sheet 10 has begun, and no detection is made by the photointerrupter 202, control unit 85 determines that there is "no recording sheet", and the sheet feeding motor 9 is driven to rotate as it is in the clockwise direction to turn on the electromagnetic clutch 43. Then, the cap 11 returns from the second position (where a recording sheet is made passable) to the first position (the capping position shown in FIG. 3A and FIG. 4). Thus, the flag 214 cuts off the gap between the light receiving and emitting unit 213*a* to turn off the electromagnetic clutch 43. The driving of the sheet feeding motor 9 is suspended.

In this case, on the display unit of the liquid crystal display of the recording apparatus, an indication of "no recording sheet" appears. For a recording apparatus provided with several LEDs, the user can be notified of no setting of recording sheet 10 by turning on and off such LEDs or by combining the blinking conditions thereof. Also, control unit 85 may transfer the information of "no recording sheet" to the computer which is connected with the recording apparatus so as to indicate "no recording sheet" on the screen of the display or inform the user of such condition as "no recording sheet" by use of voices.

Now, with reference to FIG. 1, the description will be made of the feeding and carrying of a recording medium by the ink jet recording apparatus, to which the present invention is applicable, in accordance with the first embodiment thereof. In FIG. 1, a reference numeral 216 designates the leading position of the recording sheet (recording medium) 10 when recording is initiated; 217, the leading edge position where the leading edge of the recording sheet slips on the carrying roller 12; and 218, the position of the leading edge of the recording sheet when the recording sheet 10 has been detected by means of the photo-interrupter 202. When the recording sheet 10 is detected after it has been detected that the cap 11 arrives at the second position (the position where a recording medium is made passable), the sheet feeding motor 9 is driven with reference to the timing of the recording sheet detection so that the carrying roller 12 is allowed to rotate to carry the recording sheet 10 from the position 218 to the position 216.

If a recording sheet should be detected before it has been detected that the cap 11 has arrived at the second position for some reasons, the leading edge of the recording sheet may be in a state of slipping on the carrying roller 12 at the position 217 as described earlier, and there is a possibility that recording is initiated before the regulated position where it should be initiated if the recording sheet is carried with reference to the timing of the recording sheet detection. In the worst case, recording is made on the platen. Therefore, in this case, the control should be performed so that the leading edge of the recording sheet is carried to the position 217 by all means after the presence of the recording sheet has been detected, and that the slipping condition is effectuated on the carrying roller 12. After that, the recording sheet should be carried from the position 217 to the position 216.

Figures 13, 13A:
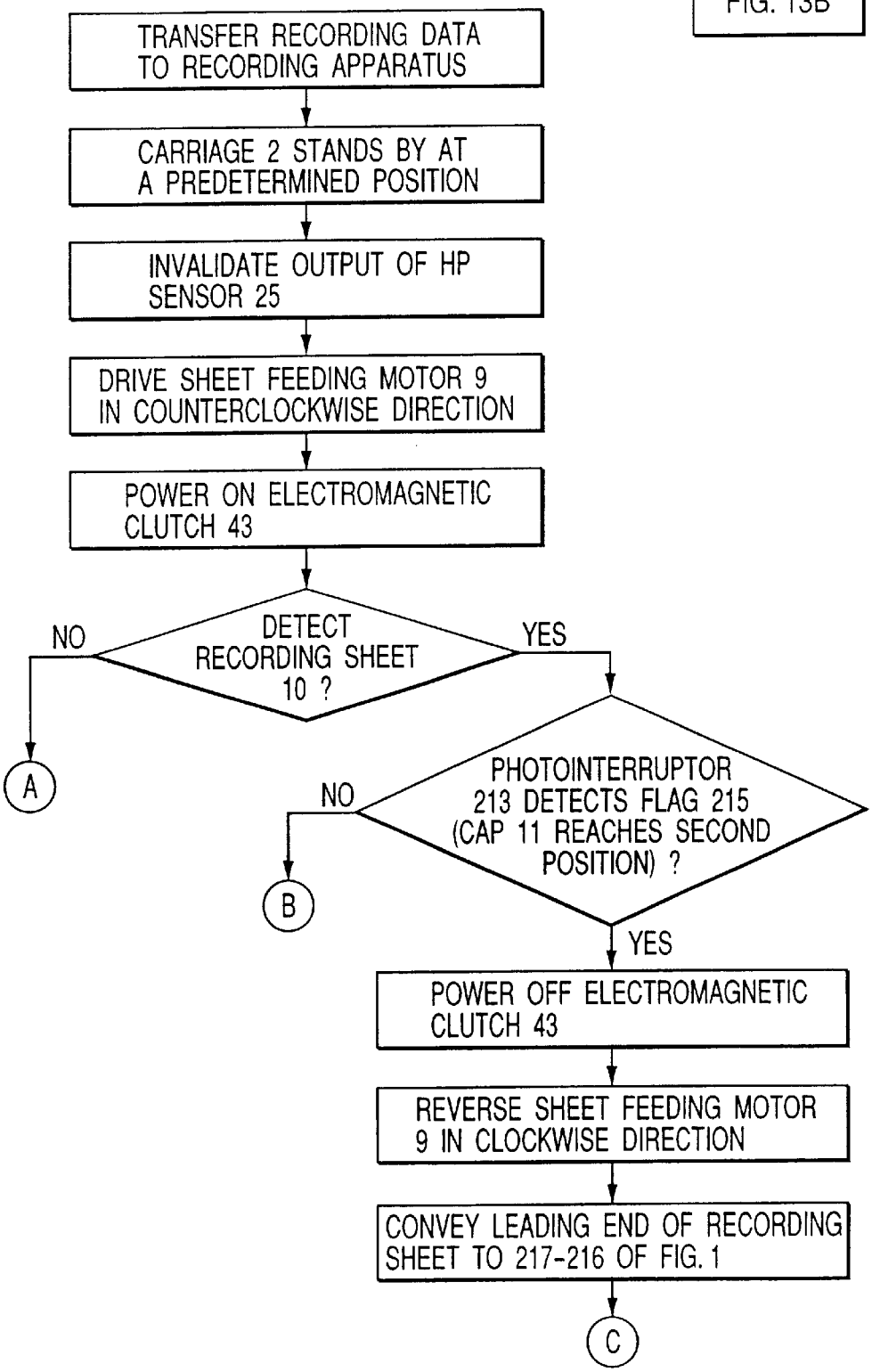
FIG. 13 is comprised of FIGS. 13A and 13B showing flowcharts of the operation of the ink jet recording apparatus, for which the present invention is applicable, from the reception of recording data to the initiation of recording in accordance with the first embodiment thereof.
Figure 13B:
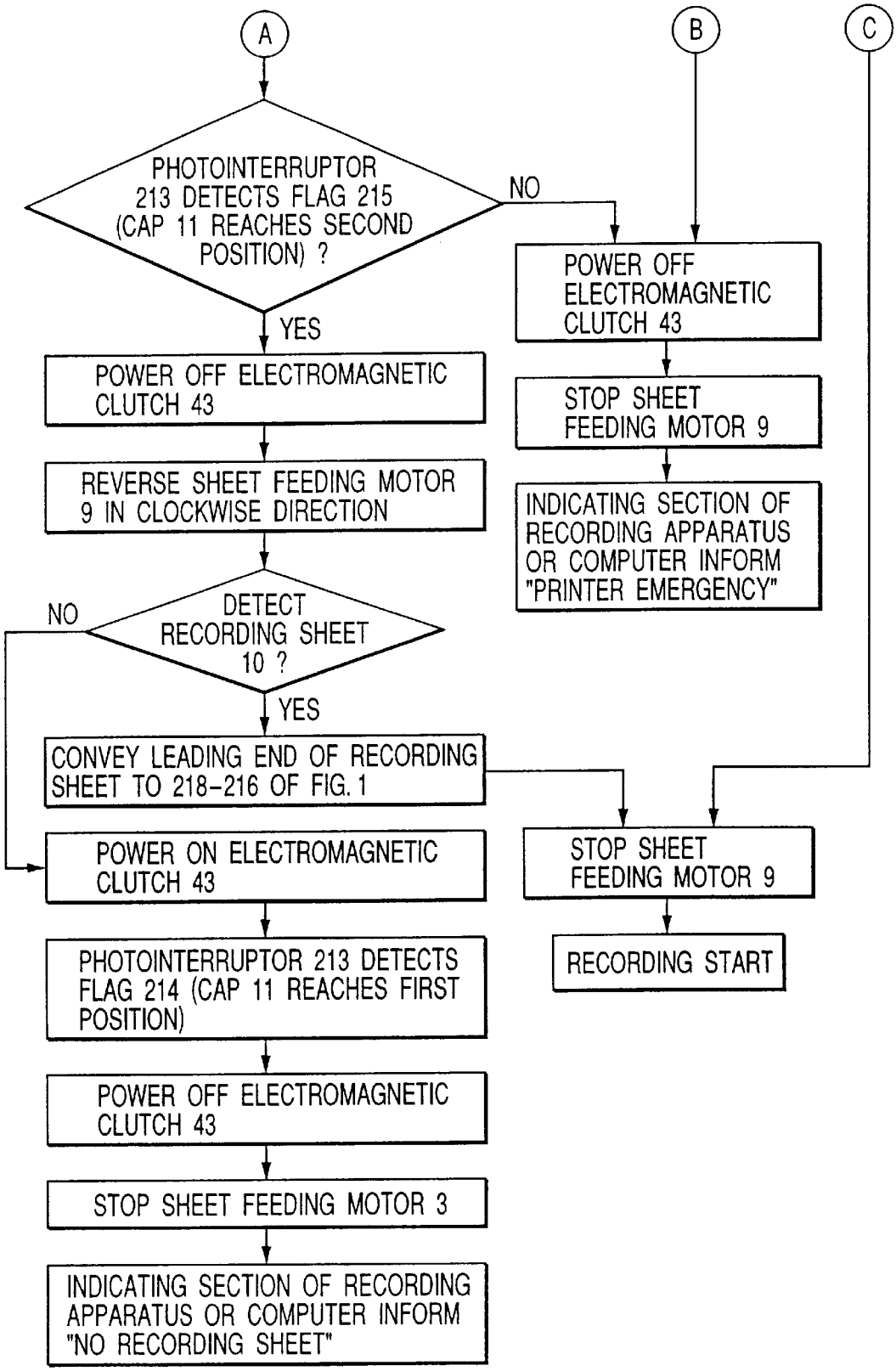

In other words, for the system where recording sheet detection means is arranged in front of the carrying roller 12, the control should be performed so that the carrying mode is allowed to change after the detection of a recording sheet depending on the timing at which the cap 11 arrives at the second position. When the recording sheet 10 arrives at the position where recording is initiated, the sheet feeding motor 9 is suspended, and the recording head 1 is driven in the main scanning direction to begin recording operation. FIGS. 13A and 13B are flowcharts which show the operational sequence from the reception of recording data to the initiation of recording for the recording apparatus in accordance with the first embodiment which has been described above.

On the second position (where a recording sheet is made passable) of the cap 11 shown in FIG. 3B and FIG. 5, the platen surface 80*a* of the second platen 48 is at the same height as that of the platen surface 80*b* of the first platen 47. Therefore, the cap 11 and the recording sheet are cut off by means of the second platen 48 during the sheet passage and recording, and there is no possibility that the recording sheet is stained by ink that adheres to the cap 11. Also, on the way of recording images which require a large amount of ink shooting, it is possible to reduce uniformly the cockling of a recording sheet by means of the first platen 47 and the second platen 48 over the entire area in the widthwise direction of the recording sheet. As described above, the second platen 48 and the rotation base 37 share the sheet feeding motor 9 for use as driving power source, and at the same time, the structure is arranged so that these members rotate integrally with the rotational shaft 40 as the common driving fulcrum. As a result, the number of the driving power sources can be still the same as that adopted by the conventional apparatus, not leading to making the recording apparatus larger. Then, this arrangement can be materialized at low costs.

As shown in FIG. 4, in accordance with the present embodiment, the locus 55 (two-dot chain lines) of the second platen 48 is overlapped with the traveling area of the carriage 2 (recording head 1) on the portion indicated by slanted lines 56 when the second platen rotates, and the carriage 2 moves earlier to be on standby on an arbitrary position in order to avoid any collision as described earlier. Instead, however, it may be possible to arrange the structure so that the cap 11 is able to reach the second position before the carriage returns again above the cap 11 after the carriage 2 has begun to move. With this arrangement, it becomes unnecessary to stop the movement of the carriage 2 (to keep it on standby). For example, while the cap 11 is being driven, the carriage 2 may be driven at slower speed or while the sheet feeding motor 9 is driven at high speed, the cap 11 is shifted to the second position, or it may be possible to execute them in combination.

The operation of each part is the same as the conventional example during recording. As described in conjunction with FIG. 2, the driving power of the carriage motor 5 is transmitted to the carriage 2 through the carriage belt 8 which is tensioned around the driving pulley 6 and the idler pulley 7. In this way, the carriage 2 is driven, and the traveling direction and position of the carriage is controlled. On the sheet passable position in FIG. 5 (the position where a recording medium is made passable), the recording head 1 held on the carriage 2 is allowed to move on the recording sheet 10, and travels over a predetermined distance on the surface of the recording sheet 10 in the main scanning direction (the direction perpendicular to the surface of FIG. 5), and then, the traveling direction is reversed at the position indicated by dotted lines 54 in FIG. 2, hence reciprocating in the directions indicated by the double-mark arrow 15. During this period, ink is discharged onto specific positions on the recording sheet 10 to record images one after another. In FIG. 5, the driving power of the sheet feeding motor 9 is transmitted to the carrying roller 12 by way of the motor gear 27 (see FIG. 1), the relay gear 29 (FIG. 1), and the carrying roller gear 28. Thus, the recording sheet 10 is carried in a specific length in the direction indicated by an arrow 16 per completion of one scanning of the recording head 1. The recording is made by repeating the operation as has been described above.

During the recording operation, the electro-magnetic clutch 43 is turned off, and the rotation of the rotational gear 42 is not transmitted to the rotation base 37. Therefore, the second platen 48 and the cap 11 are maintained on the second position (where the recording sheet is made passable) in FIG. 5 and FIG. 3B. Also, during recording, the sensor flag 26 of the carriage 2 passes the HP sensor 25 twice one scanning (one reciprocation). However, the structure is arranged so that the output of the HP sensor 25 is invalidated to make it unnecessary for the carriage 2 to stop at the capping position during recording.

Now, with reference to FIG. 1, FIG. 4, and FIG. 5, the description will be further made of the operation of the ink jet recording apparatus in accordance with the first embodiment. After the termination of recording on one recording sheet 10, the carriage 2 is on standby at an arbitrary position in the main scanning direction, and the sheet feeding motor 9 is driven in the clockwise direction to enable the trailing edge of the recording sheet 10 (not shown) to pass the edge portion 201*c* of the trailing edge detection sensor. Then, after the other edge 201*b* cut off the photointerrupter 202, the carrying roller 12 rotates in a predetermined amount in the direction indicated by an arrow 16 so as to carry the recording sheet 10 until it passes through between the exit roller 31 and the exit spur 32. Subsequently, if control unit 85 determines that the recording sheet 10 has been led out, the electromagnetic clutch 43 is turned on to make the driving transmission possible for the rotational gear 42, the rotational shaft 40, and the rotation base 37 (to keep them in the connected condition), while the driving of the sheet feeding motor 9 is kept as it is.

In this manner, the driving power is transmitted through the relay gear 29, the rotational gear 42, and the rotational shaft 40 to enable the rotation base 37 to rotate in the clockwise direction from the second position in FIG. 5, together with the second platen 48, the cap base 35, the cap 11, and the like which are fixed thereto. Then, the flag 215 has passed between the light receiving and emitting unit 213*a*, and the cap 11 arrives at the first position shown in FIG. 4. As a result, the flag 214 is in a state to cut off between the light receiving and emitting unit 213*a*, hence turning off the electromagnetic clutch 43 to suspend the driving of the sheet feeding motor 9. At this juncture, the output of the HP sensor 25 is validated by means of the control means which is not shown. Then, subsequently, the carriage 2 which is on standby begins to move toward the capping position, and when the home position sensor 25 detects the sensor flag 26 shown in FIG. 1, the carriage 2 stops at the capping position for the recording head 1, hence presenting the capping status as shown in FIG. 3A and FIG. 4.

It has been described earlier that the carriage 2 is on standby at an arbitrary position, but should the structure be arranged so that the cap 11 returns to the first position (capping status) before the carriage 2 returns above the cap 11 in the same way as prior to recording, it becomes unnecessary for the carriage 2 to be stopped (to be on standby). As shown in FIG. 12A, the swinging gear 207 faces the toothless portion (where no tooth is cut) 205*a* of the PU gear 205 during such period. Therefore, no driving power is transmitted to the PU roller 204, and there is no feeding of any recording sheet 10 on the tray 203.

If it is not detected before recording that the cap 11 arrives at the second position from the state where it has been on the first position even after the passage of a predetermined time since the electro-magnetic clutch 43 has been turned on or the cap does not move from the first position, the electro-magnetic clutch 43 should be turned off to stop the sheet feeding motor 9, thus suspending the feeding of the recording sheet. If it is not detected after recording that the cap 11 arrives at the first position from the state where it has been on the second position even after the passage of a predetermined time since the electromagnetic clutch 43 has been turned on or the cap does not move from the second position, the electro-magnetic clutch 43 should be turned off to stop the sheet feeding motor 9.

In either case, control unit 85 determines whether or not there is any emergency in operating an ink jet recording apparatus, and if an emergency exists, an indication of "emergency in printer" appears on the display unit of the liquid crystal display of the recording apparatus. For a recording apparatus provided with several LEDs, the user can be notified of such emergency in the apparatus by turning them on and off or by combining the blinking conditions thereof. Also, the structure maybe arranged so that control unit 85 transfers the information of "emergency in printer" to the computer which is connected with the recording apparatus to indicate "emergency in printer" on the screen of the display or inform the user of such condition as emergency in the apparatus by use of voices. If the cap 11 does not return to the first position from the second position after recording, the user should be informed to remove the recording head 1 from the carriage 2 and keep the head in the protective container designated by the manufacturer, because should this condition be left intact, there is a fear that ink is dried on the discharge port portion to clog it eventually in some cases.

Here, the structure is arranged so that during the period when the cap 11 is driven between the first position and the second position, the carriage 2 is on standby at an arbitrary position in the main scanning direction, and if such an emergency should take place as described above, the carriage motor 5 is suspended at that position, thus enabling the recording head 1 or the ink tanks 22*a* to 22*d* to be removed or installed. It is structured to suspend the carriage motor outside the capping position, and to effectuate the removal and installation thereof possible there. Therefore, even if the cap 11 should stop in the middle of the first and second positions so as to allow the second platen 48 to be protruded to the traveling locus region of the carriage 2 (recording head 1), there is no possibility that carriage 2 collides against the second platen 48. In this case, too, the user is informed of the event that a recording head 1 can be removed or installed through the indication to that extent which appears on the liquid crystal display of an ink jet recording apparatus or on the screen of the display provided for a computer.

Figure 14:
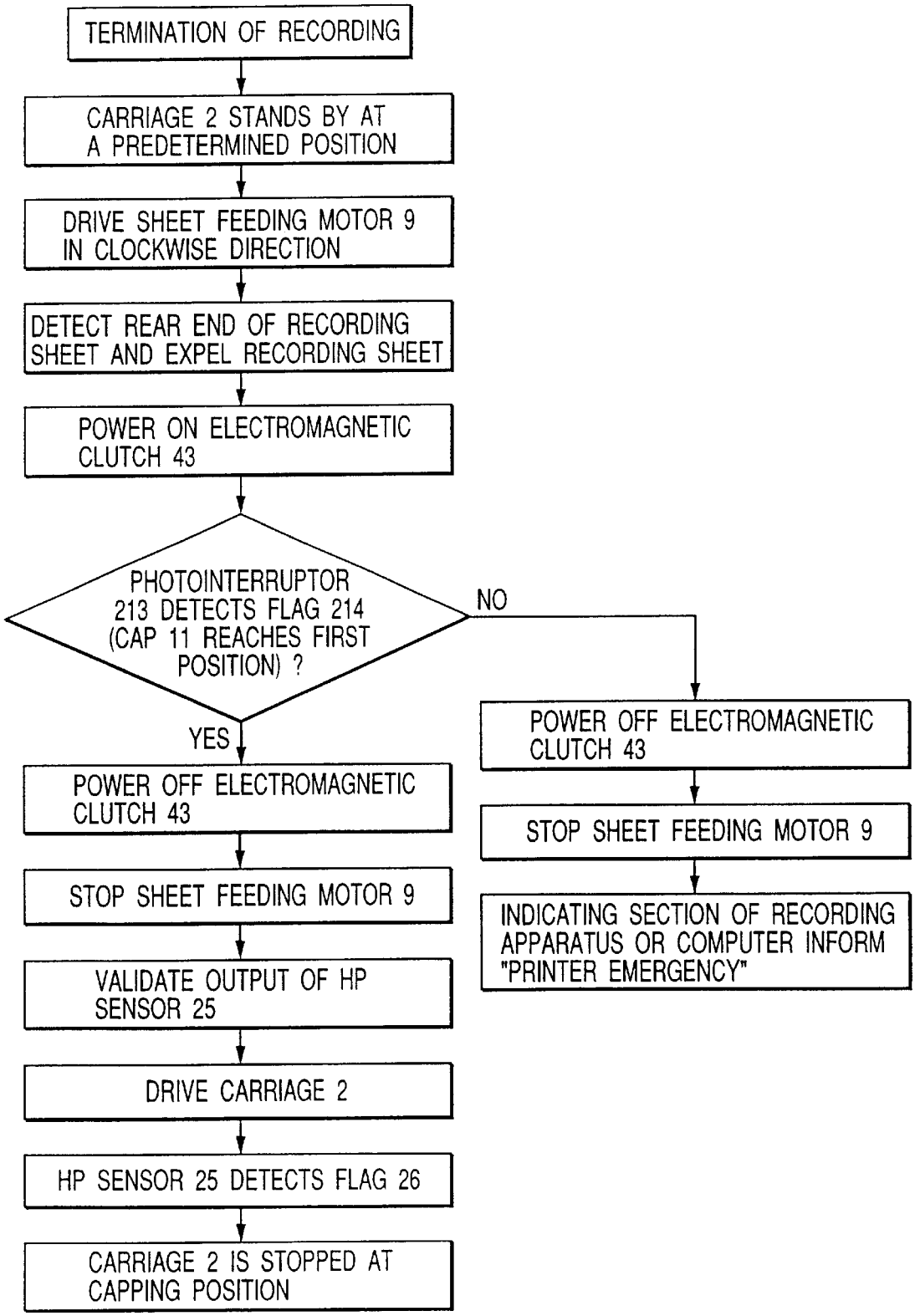
FIG. 14 is a flowchart which shows the operation of the ink jet recording apparatus, for which the present invention is applicable, from the termination of recording to capping in accordance with the first embodiment thereof.
Figure 20:
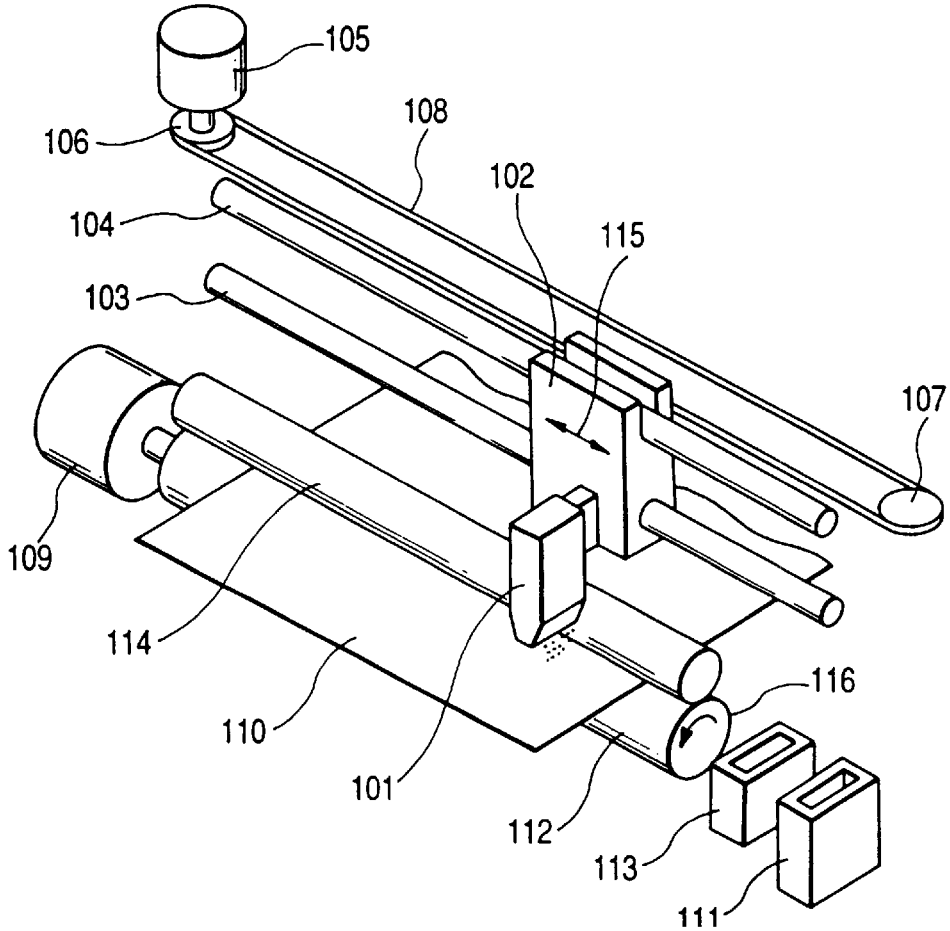
FIG. 20 (PRIOR ART)
FIG. 20 is a perspective view which shows the conventional example of the ink jet recording apparatus which forms images by the relative scanning of recording means and a recording medium.
Figure 21:
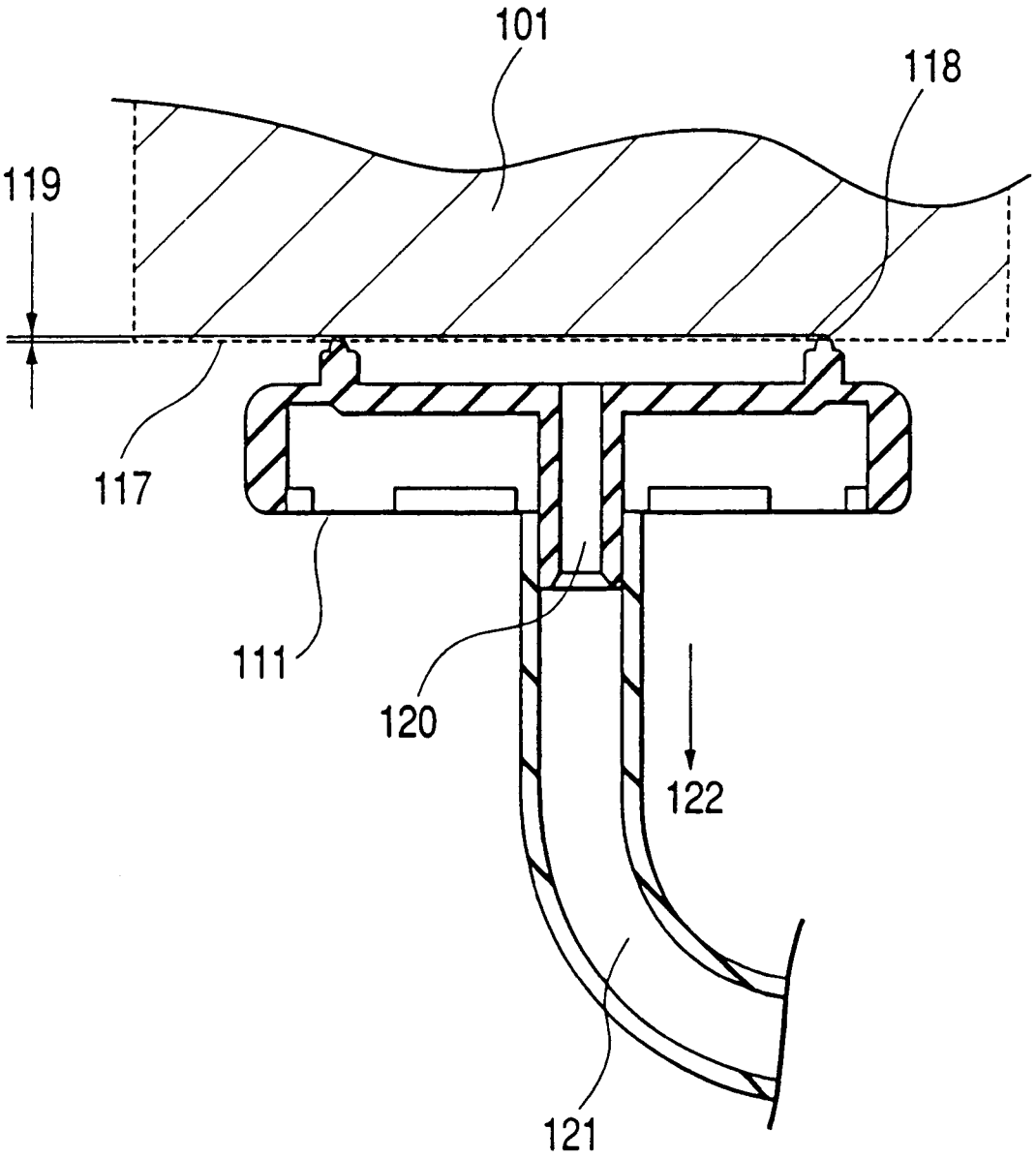
FIG. 21 (PRIOR ART)
FIG. 21 is a vertically sectional view which schematically shows the state where the cap is closely in contact with the discharge port surface of recording means represented in FIG. 20.

FIG. 14 is a flowchart which shows the operational sequence in which the recording head 1 returns to the capping position from the moment that recording has terminated. The state shown in FIG. 1 and FIG. 3A, that is, the state where the cap 11 is closely in contact with the discharge port surface of the recording head 1 at the first position, is the same as the state of the cap 111 and discharge port surface 117 of the conventional example described in conjunction with FIG. 20 and FIG. 21. In this state, the recovery pump 44 shown in FIG. 2 is driven to suck the air in the tube 21 in the direction indicated by an arrow 58. Ink in the recording head 1 is sucked, and at the same time, ink in the ink tanks 22*a* to 22*d* is brought into the recording head 1. In this way, bubbles and the like in the recording head 1 are removed. Ink sucked by the recovery pump 44 is led into the waste ink absorbent 46 through the waste ink tube 45, and absorbed and kept in the absorbent.

Figure 6A:
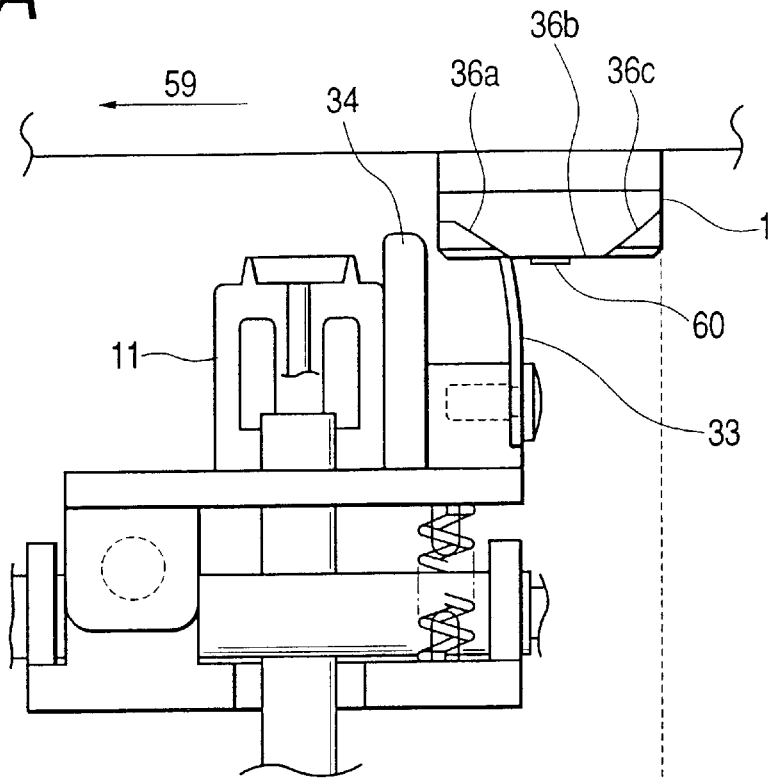
FIGS. 6A and 6B are partially elevated views which illustrate the structure and operation of a retractive cam and a cam follower, and the circumferential portion thereof when recording means is on the way of its shift to the capping position, observed in the direction indicated by an arrow B in FIG. 1.

FIGS. 6A and 6B and FIGS. 7A, 7B, and 7C are partially elevated views which illustrate the structure and operation of the retractive cam 34, the cam follower 36, and the circumferential portions thereof, observed in the direction indicated by the arrow B in FIG. 1. FIGS. 6A and 6B, and FIGS. 7A, 7B, and 7C illustrate the states which appear in series from FIGS. 6A to 7C and represent the process in which the cap 11 returns to the first position (capping status) after recording, and then, the recording head 1 returns to the capping position in continuation. FIG. 6A shows the state immediately before the discharge port portion 60 reaches the wiping member 33 after the recording head 1 moves in the direction indicated by the arrow 59. The wiping member 33 is elastically deformed as shown in FIG. 6A and abuts against the surface of the recording head 1 (discharge port surface 91). Then, from this moment, ink droplets adhering to the circumference of the discharge port portion 60 are being removed. At this juncture, the cam follower 36 formed on the recording head 1 is yet to arrive at the retractive cam 34.

Figure 6B:
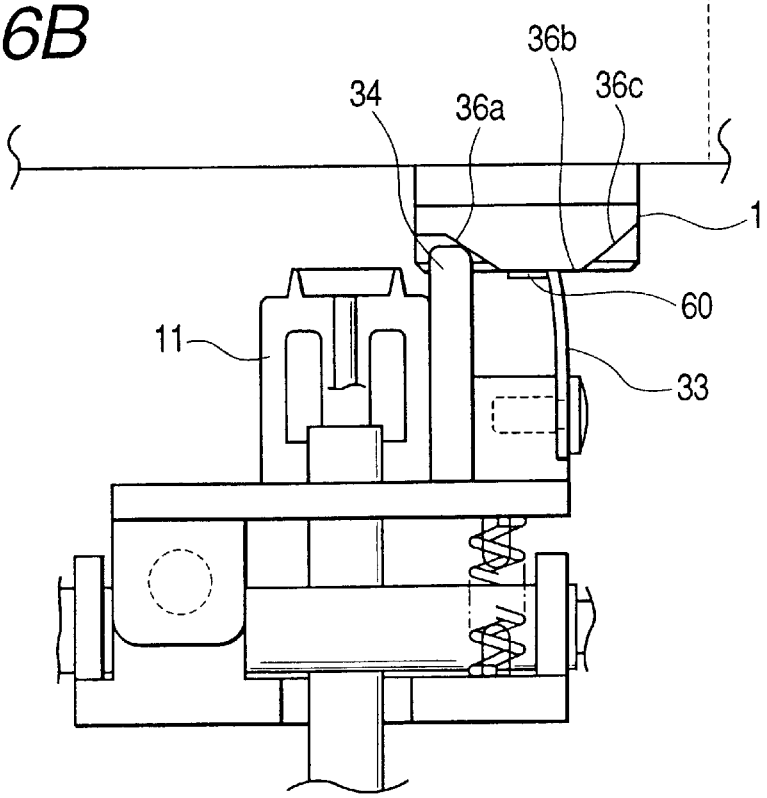
Figure 7A:
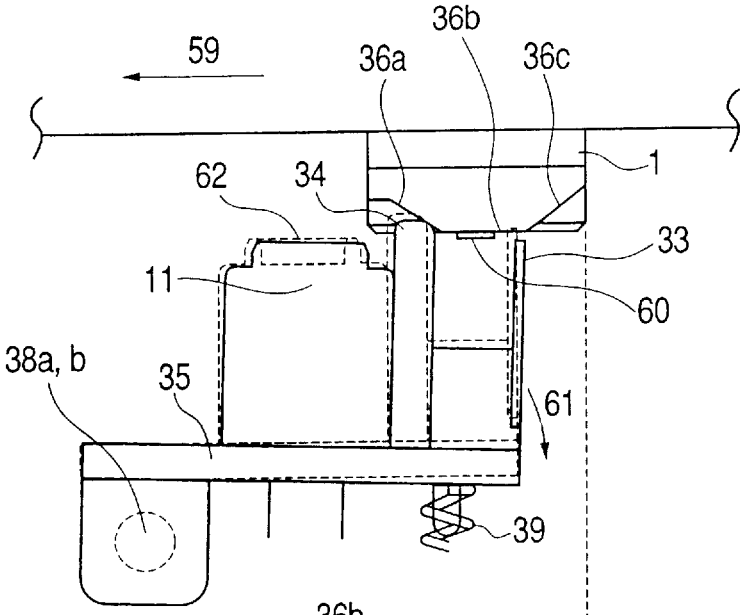
FIGS. 7A, 7B, and 7C are partially elevated views which illustrate the structure and operation of the retractive cam and cam follower, and circumferential portion thereof when the carriage moves further from the state shown in FIGS. 6A and 6B to the state where capping is effectuated, observed in the direction indicated by an arrow B in FIG. 1.
Figure 7B:
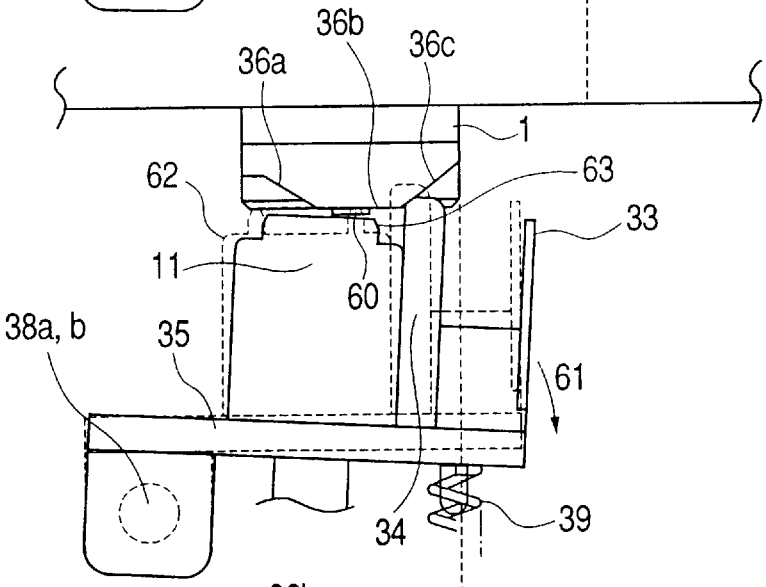
Figure 7C:
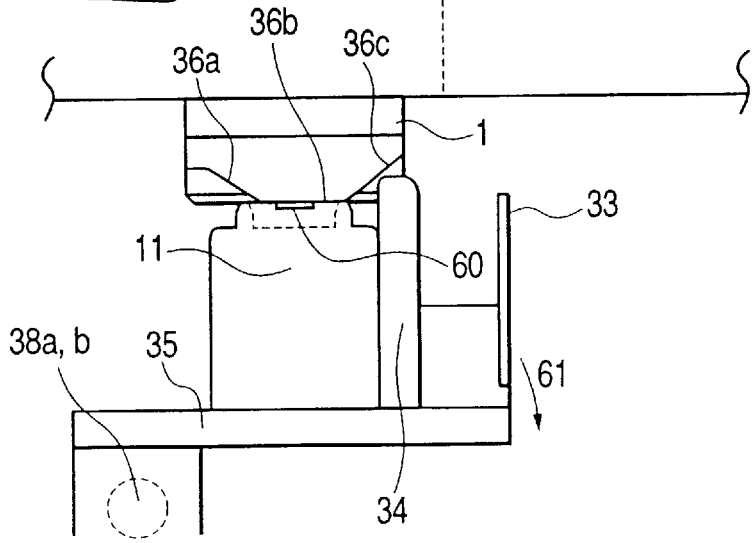

FIG. 6B shows the state where the recording head 1 further moves, and the removal of ink droplets by means of the wiping member 33 is almost completed. At this juncture, the retractive cam 34 is positioned immediately before its contact with the slanted surface portion 36*a* of the cam follower. FIG. 7A shows the state where the recording head 1 is moves in the direction indicated by the arrow 59, while the retractive cam 34 is in contact with the slanted surface portion 36*a* of cam follower 36. Here, the retractive cam 34 is pressed by the slanted surface portion 36*a* to compress the coil spring 39. Then, the cap base 35, the cap 11, and others rotate in the direction indicated by the arrow 61 from the position indicated by broken line 62 to the position indicated by solid line with the shafts 38*a* and 38*b* as fulcrum. FIG. 7B shows the state where the retractive cam 34 passes the portions 36*a* and 36*b* of the cam follower 36, and arrives at the slanted surface portion 36*c* of the cam follower. Between the states shown in FIG. 7A and 7B, the slanted line portion 63 of the leading rib of the cap 11 is in a state of being away from the discharge port portion 60 (discharge port surface 91) as shown in FIG. 7B, and the cap 11 and the discharge port surface 91 are in a positional relationship that these are not rubbed each other. At this juncture, the discharge port portion 60 passes right above the slanted line portion 63 of the leading rib of the cap 11. FIG. 7C shows the state where the recording head 1 (carriage 2) stops, and the retractive cam 34 parts from the slanted surface portion 36*c* of the cam follower 36 to release the compression of the coil spring 39, and then, the discharge port portion 60 (discharge port surface 91) is capped by the cap 11 exactly. This state is the same as the one when the electric supply source is turned off or on standby condition as shown in FIG. 1 and FIG. 4. The operation beginning with the sate shown in FIG. 7C to the initiation of recording is reverse to the one that has been described above in conjunction with FIGS. 6A to 7C. In other words, the retractive cam 34 moves while being in contact with each portion of the cam followers 36 in order of 36*c* →36*b* →36*a*, and then, the state becomes as shown in FIG. 6A where the recording head 1 moves in the direction opposite to the one indicated by the arrow 59 and arrives at the position where recording is initiated. Thus, recording begins. With the wiping member 33, the retractive cam 34, and the follower cam 36 (36*a* and 36*b*) being arranged and structured in the positions relationship as described above, ink droplet adhering to the circumference of the discharge port portion 60 (discharge port surface 91) can be wiped off and removed by wiping reliably. Also, the discharge port portion 60 is not allowed to rub the cap 11 while the recording 1 moves, hence preventing the discharge port portion 60 from being damaged.

Second Embodiment

Figure 15A:
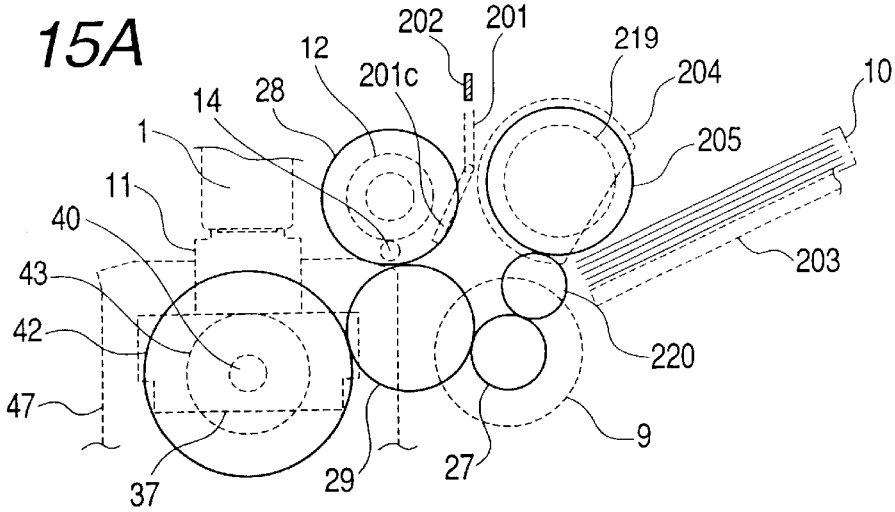
FIGS. 15A, 15B, and 15C are views which illustrate schematically the driving power transmission system and the feeding operation of a recording medium for the ink jet recording apparatus to which the present invention is applicable in accordance with the second embodiment thereof.
Figure 15B:
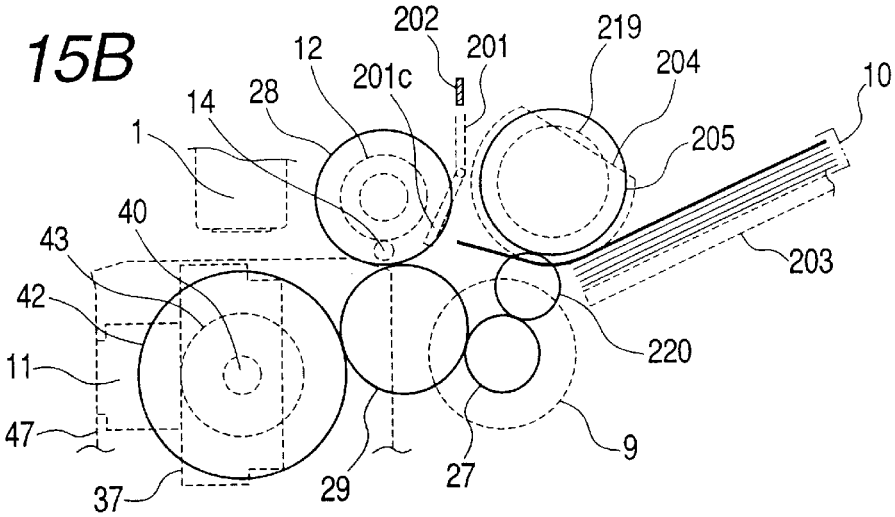
Figure 15C:
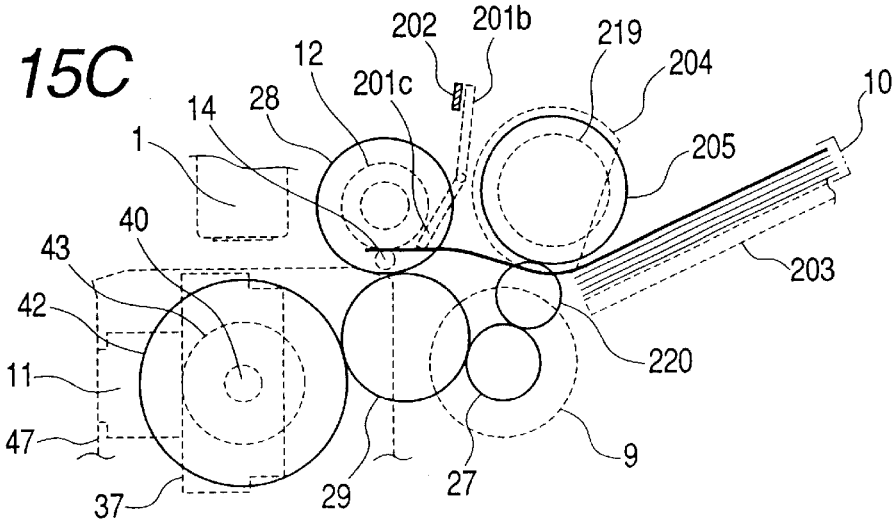

For the embodiment described above, the structure is arranged to rotate the cap 11 by turning on the electromagnetic clutch 43 at the same time that the sheet feeding is initiated. However, in place of this arrangement, the structure may be formed so that the sheet feeding is initiated after the cap 11 has rotated to the second position (the position where the conveyance of a recording medium is made possible). FIGS. 15A, 15B, and 15C are views which schematically illustrate the driving power transmission system, and the feeding operation of a recording medium in accordance with the second embodiment structured as described above. In this respect, for the description of the driving power transmission system and the feeding operation of the recording medium, the pitch circle of each gear and the recording sheet 10 are indicated by solid lines, while the others parts are indicated by solid lines. In FIGS. 15A, 15B, and 15C, the same reference marks are applied to the same or corresponding parts as those appearing in the first embodiment described in conjunction with FIGS. 12A to 12C and others. Then, the detailed description thereof will be omitted.

In FIGS. 15A to 15C, a reference numeral 219 designates an electromagnetic clutch. A PU gear 205 is fixed to the input shaft (not shown) of the electro-magnetic clutch 219, and a PU roller 204 is fixed to the output shaft (not shown) of the electromagnetic clutch 219; 220, a sheet feeding relay gear, and the sheet feeding relay gear 220 transmits the driving power of a motor gear 27 to the PU gear 205. FIG. 15A shows the state where the cap 11 is at the first position (capping status). When recording data are transmitted from a computer or the like to the ink jet recording apparatus, the electromagnetic clutch 43 is turned on to drive the sheet feeding motor 9 in the counterclockwise direction. Thus, as in the first embodiment, the sheet feeding motor 9 rotates in the counterclockwise direction until it is detected that the cap 11 has arrived at the second position. During this period, the electromagnetic clutch 219 is turned off, and the input shaft and output shaft thereof are not connected. Therefore, the driving power of the sheet feeding motor 9 is not transmitted to the PU roller 204, hence no recording sheet 10 being fed.

Also as in the first embodiment, when the cap 11 rotates from the first position to the second position, the sheet feeding motor 9 is driven in the counter-clockwise direction, and likewise, the carrying roller 12 rotates in the counter-clockwise through the relay gear 29. Therefore, even if, for some reasons, the user pushes in a recording sheet 10 strongly, for example, or for reasons that a recording sheet 10 is inserted from a manual sheet feeding stand (not shown), not from the tray 203, the leading edge of the recording sheet 10 may arrive at the carrying roller 12 beyond the sheet edge detection flag 201*c* before the cap 11 reaches the second position, the carrying roller 12 is structured to carry the leading edge of the recording sheet 10 in the direction opposite to the one at the time of recording. As a result, the leading edge of the recording sheet 10 slips on the carrying roller 12, and the recording sheet is not allowed to move. There is no possibility that the leading edge of the recording sheet 10 is carried over the carrying roller 12 and inserted into the recording portion. Thus, the discharge port surface 91 (discharge port portion 60) is not rubbed nor the recording sheet 10 is stained to spoil it. Also, the sheet edge detection flag 201*c* is provided with the setting detection means which dually function to detect the setting of a recording sheet on the recording apparatus when sheet feeding is manually carried out as in the case of the embodiment described earlier.

FIG. 15B shows the state where the cap 11 arrives at the second position. When it is detected that the cap 11 has arrived at the second position, the driving of the sheet feeding motor 9 is reversed from the counterclockwise direction to the clockwise direction, and the electromagnetic clutch 219 is turned on. The driving power of the sheet feeding motor 9 is transmitted to the PU roller 204 to initiate sheet feeding. FIG. 15B shows the state where the uppermost recording sheet 10 on the tray 203 has already been fed to a certain extent. At this juncture, the same as the PU roller 204, the carrying roller 12 rotates in the clockwise direction.

The sheet feeding operation continues from the state shown in FIG. 15B, and the PU gear 205 and the PU roller 204 rotate continuously in the clockwise direction. Thus, the recording sheet 10 is carried toward the recording unit where the recording head 1 is arranged. FIG. 15C shows the state where the recording sheet 10 arrives at the edge portion 201*c* of the sheet edge detection flag, and the edge portion 201*b* of the sheet edge detection flag on the opposite side is now out of the light emitting and receiving unit of the photointerrupter 202. The recording sheet 10 is carried to the position of recording initiation (at 216 in FIG. 1) with the position (at 218 in FIG. 1) detected by the photointerrupter 202 being a reference. During this period, the recording sheet 10 is pinched by the carrying roller 12 and the pressure roller 14, and the electromagnetic clutch 219 is turned off when facing a cut off part of the circular surface of the PU roller 204. Thereafter, the recording sheet is carried by the carrying roller 12 and the pressure roller 14, and when the recording sheet is carried to the position of recording initiation (at 216 in FIG. 1), the sheet feeding motor 9 is suspended and recording is initiated.

Figures 16, 16A:
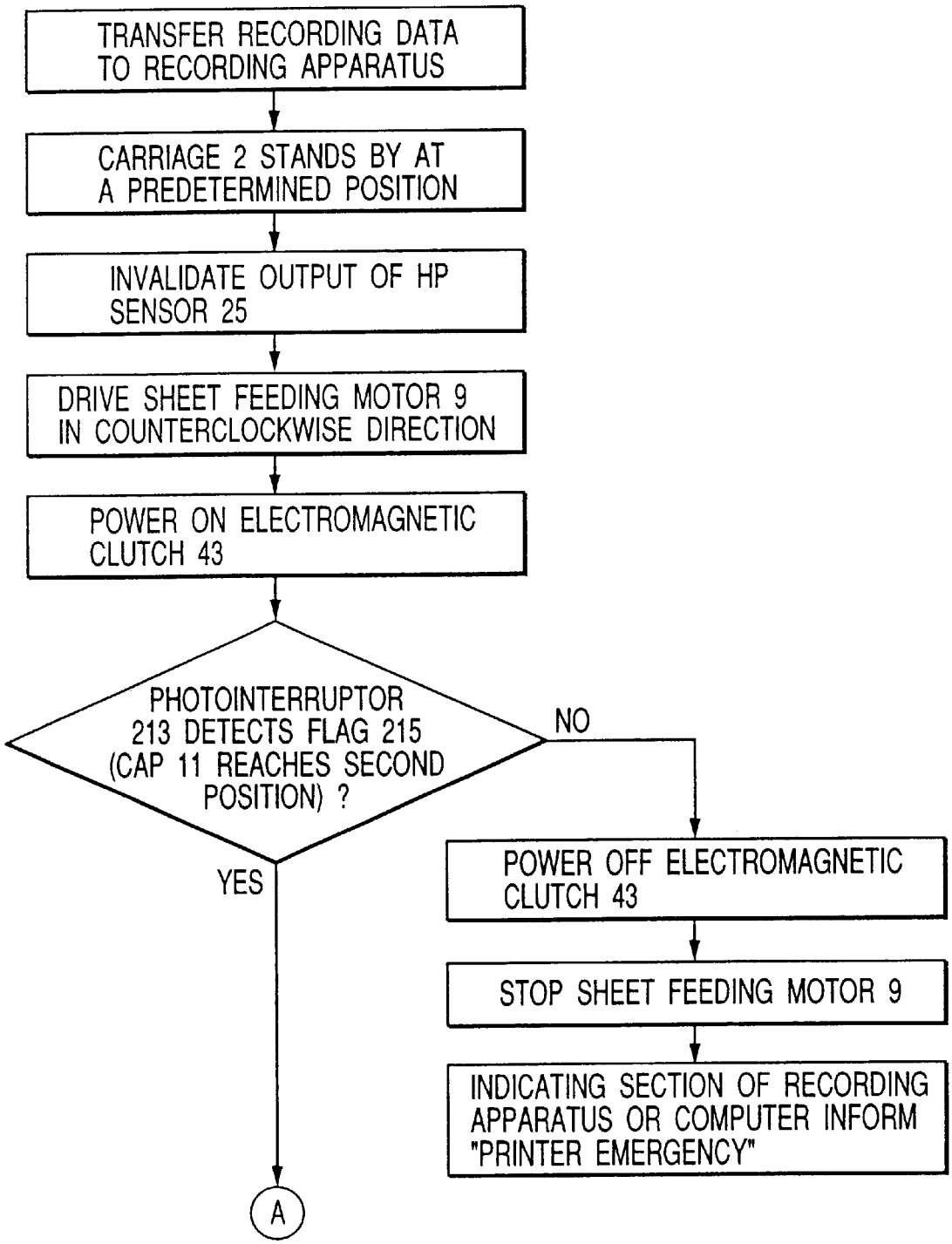
FIG. 16 comprised of FIGS. 16A and 16B showing flowcharts of the operation of the ink jet recording apparatus, for which the present invention is applicable, from the reception of recording data to the initiation of recording in accordance with the second embodiment thereof.
Figure 16B:
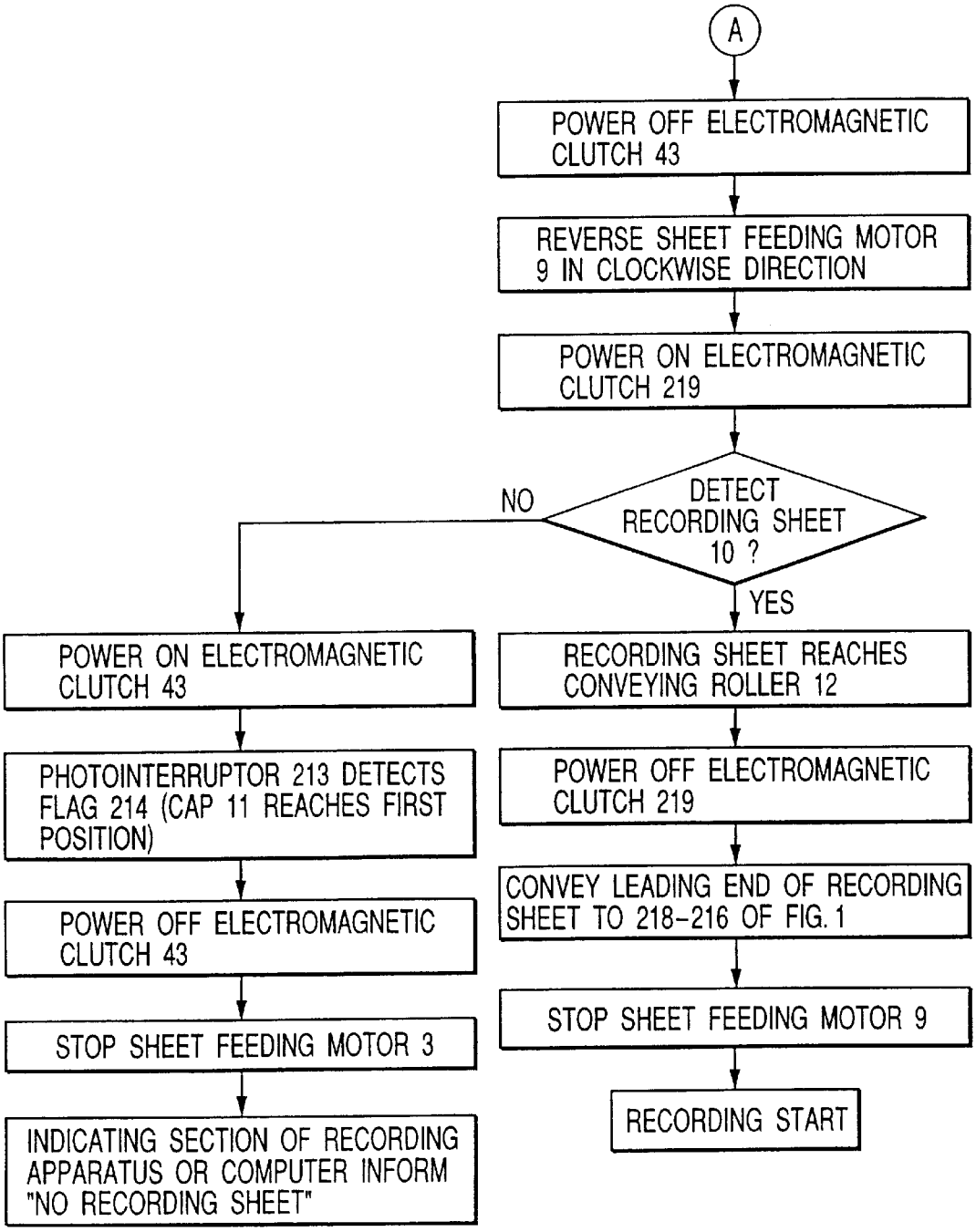

FIGS. 16A and 16B are flowcharts which show the operational sequence from the transmission of recording data to the recording apparatus shown in FIGS. 15A to 15C and the initiation of recording. If the recording sheet 10 is not detected by the photointerrupter 202 even after a predetermined time elapses since the feeding of the recording sheet has began, control unit 85 determines that there is "no recording sheet " as in the embodiment described earlier, and the electromagnetic clutch 219 is turned off to suspend the sheet feeding, and at the same time, the sheet feeding motor 9 is driven to rotate as it is in the clockwise direction to turn on the electromagnetic clutch 43. Then, the cap 11 returns from the second position to the first position shown in FIG. 4. Thus, the flag 214 cuts off the gap between the light emitting and receiving unit 213*a* to turn off the electromagnetic clutch 43. The driving of the sheet feeding motor 9 is suspended. In this case, on the display unit of the liquid crystal display of the recording apparatus, an indication of "no recording sheet" appears. For a recording apparatus provided with several LEDs, the user can be notified of no setting of recording sheet 10 by turning them on and off or by combining the blinking conditions thereof. Also, control unit 85 may transfer the information of "no recording sheet" to the computer which is connected with the recording apparatus so as to indicate "no recording sheet" on the screen of the display or inform the user of such condition as "no recording sheet" by use of voices.

In the present embodiment, the operation during recording and after the termination of recording on one sheet is the same as that of the embodiment described earlier. Therefore, the detailed description thereof will be omitted. Here, during this period, the electromagnetic clutch 219 remains to be off condition, and since the recording sheet 10 is separated from the PU roller 204 facing the portion where a part of the circular surface thereof is cut off, the second recording sheet 10 and on are still stacked on the tray 203 until the next sheet feeding instruction is issued. If it is not detected before recording that the cap 11 arrives at the second position from the state where it has been on the first position even after the passage of a predetermined time since the electromagnetic clutch 43 has been turned on or the cap does not move from the first position, the electromagnetic clutch 43 should be turned off to stop the sheet feeding motor 9, thus suspending the feeding of the recording sheet. During this period, the electromagnetic clutch 219 is turned off, and the recording sheet 10 is not fed, remaining as it is to be stacked on the tray 203.

If it is not detected after recording that the cap 11 arrives at the first position from the state where it has been on the second position even after the passage of a predetermined time since the electromagnetic clutch 43 has been turned on or the cap does not move from the second position, the electromagnetic clutch 43 should be turned off to stop the sheet feeding motor 9. In either case, control unit 85 determines whether or not there is any emergency in operating an ink jet recording apparatus as in the embodiment described earlier, and if an emergency exists, the user should be informed thereof accordingly by the indication appearing on the display unit of the liquid crystal display of the recording apparatus or on the screen of the display of a computer connected therewith. If the cap 11 does not return to the first position from the second position after recording, the user should be informed, as in the case of the embodiment described earlier, to remove the recording head 1 from the carriage 2 and keep the head in the protective container designated by the manufacturer in order to prevent the discharge port portion 60 (discharge ports 92) from being clogged.

Here, as in the embodiment described earlier, the structure is arranged so that during the period when the cap 11 is driven between the first position and the second position, the carriage 2 is on standby at an arbitrary position in the main scanning direction, and if such an emergency should take place as described above, the recording head 1 or the ink tanks 22*a* to 22*d* can be removed or installed. Therefore, should the second platen 48 be protruded to the traveling area of the carriage 2 (recording head 1), there is no possibility that carriage 2 collides against the second platen 48. In this case, too, the user is informed of the event that a recording head 1 can be removed or installed through the indication appearing on the liquid crystal display of an ink jet recording apparatus or on the screen of the display provided for a computer.

Third Embodiment

In the second embodiment described in conjunction with FIGS. 15A to 15C and FIGS. 16A and 16B, the slipping condition is created for a recording medium 10 by carrying the recording sheet exactly to the position at 217 in FIG. 1 if the recording sheet 10 is detected prior to recording by the sheet edge detection flag 201 before the cap 11 arrives at the second position, and the recording sheet is carried to the position at 218 in FIG. 1 with the position at 217 as reference. However, in place of this arrangement, it may be possible to arrange the structure so that a recording sheet 10 is detected by the sheet edge detection flag 201 before the cap 11 arrives at the second position. Thus, after the cap 11 has arrived at the second position, the recording sheet is once returned to the right-hand side from the position at 218 in FIG. 1, and then, carried again with the position at 218 as reference.

Figure 17A:
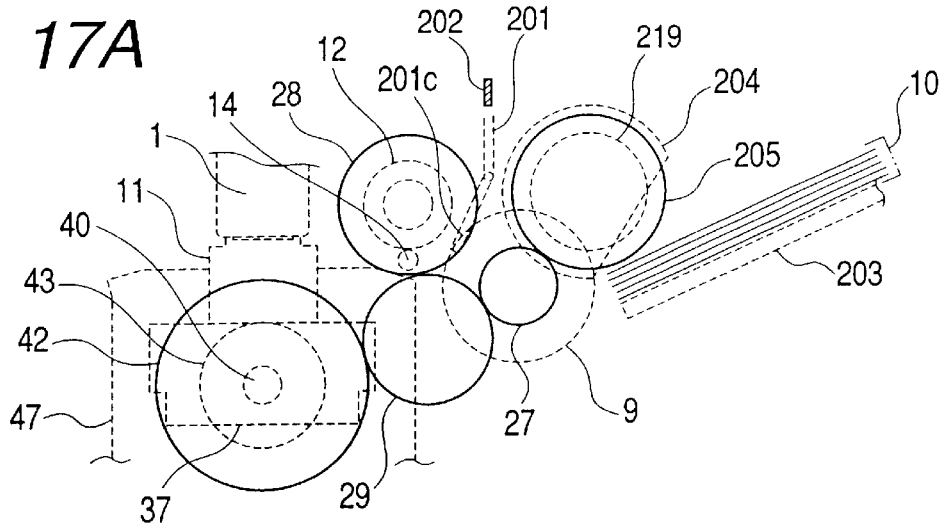
FIGS. 17A, 17B, and 17C are views which illustrate schematically the driving power transmission system and the feeding operation of a recording medium for the ink jet recording apparatus to which the present invention is applicable in accordance with the third embodiment thereof.
Figure 17B:
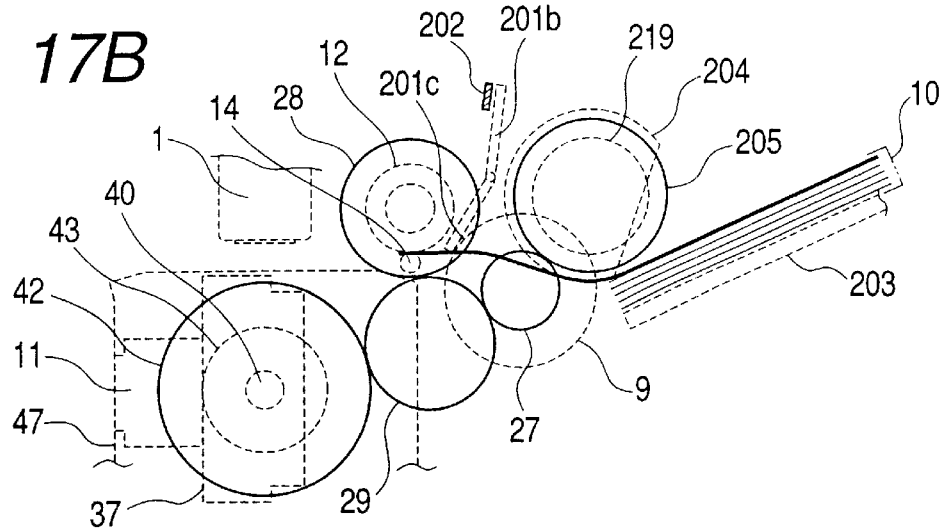
Figure 17C:
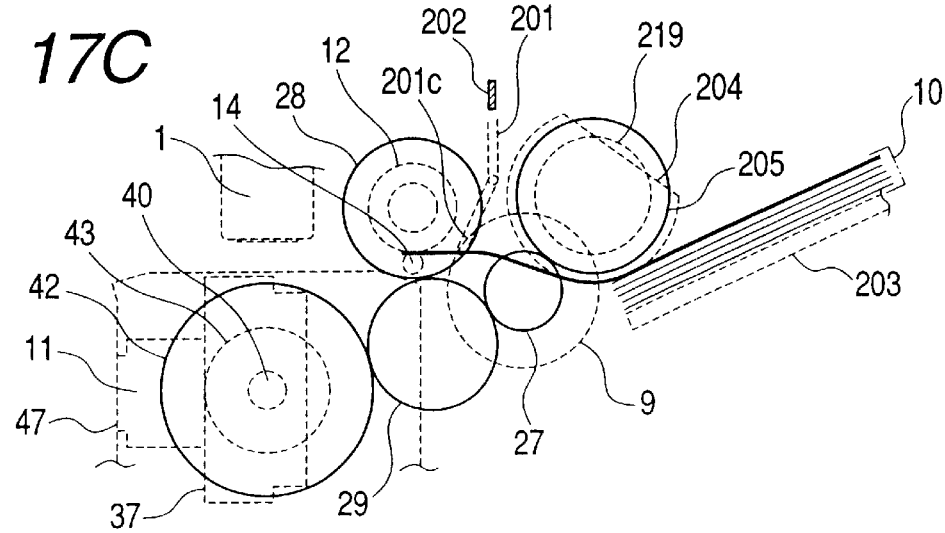

FIGS. 17A, 17B, and 17C are views which illustrate schematically the driving power transmission system and the feeding operation of a recording medium in accordance with the third embodiment which is structured as described above. The third embodiment represented in FIGS. 17A to 17C is structured as the second embodiment described in conjunction with FIGS. 15A to 15C with the omission of the sheet feeding relay gear 220. In this respect, for the description of the driving power transmission system and the feeding operation of a recording medium, the pitch circle of each gear and the recording sheet 10 are indicated by solid lines, and the other parts are indicated by broken lines in FIGS. 17A to 17C. Also, in FIGS. 17A to 17C, the same reference marks are applied to the same or corresponding parts appearing in FIGS. 12A to 12C which represent the first embodiment and in FIGS. 15A to 15C which represent the second embodiment. The detailed description of the structures and operations thereof will be omitted.

FIG. 17A shows the state where the cap 11 is at the first position. When a computer transmits recording data to the ink jet recording apparatus, the electromagnetic clutch 43 is turned on to drive the sheet feeding motor 9 to rotate in the counter-clockwise direction. Then, as in the embodiment described earlier, the cap 11 rotates in the counter-clockwise direction until when it is detected that the cap 11 has arrived at the second position. At this juncture, the electromagnetic clutch 219 is also turned on to connect the input shaft and output shaft (not shown) to driving power of the sheet feeding motor 9 to the PU roller 204. The PU roller 204 rotates in the clockwise direction to feed the recording sheet 10 in the direction toward the recording head 1.

As shown in FIG. 17B, by the time that the arrival of the cap 11 at the second position is detected, the leading edge of the recording sheet 10 has already passed the sheet edge detection flag 201*c*. The edge portion 201*b* of the sheet edge detection flag on the opposite side is out of the light emitting and light receiving unit of the photointerrupter 202. The leading edge of the recording sheet 10 reaches the carrying roller 12 and the pressure roller 14. As in the embodiment described earlier, during the rotation of the cap 11, the sheet feeding motor 9 is driven in the counterclockwise direction, and the carrying roller 12 also rotates in the counterclockwise direction through the relay gear 29. Therefore, even if the leading edge of the recording sheet 10 reaches the carrying roller 12, the leading edge portion of the recording sheet 10 slips as it is on the carrying roller 12 and does not move forward. As a result, the leading edge of the recording sheet 10 is not allowed to run beyond the carrying roller 12 so as not to rub the discharge port surface and damage it or to stain the recording sheet 10 and spoil it.

As in the embodiment described earlier, for a manual sheet feeding, it is arranged that the sheet edge detection flag 201 is provided with a dual function to detect the setting of a recording medium (recording sheet) on a recording apparatus. The arrival of the cap 11 at the second position is detected to turn off the electromagnetic clutch 43.

The driving of the sheet feeding motor 9 is immediately reversed to be in the clockwise direction, and the PU roller 204 rotates in the counterclockwise direction to cause the leading edge of the recording sheet 10 to return to reside in front of the sheet edge detection flag 201*c*. As shown in FIG. 17C, when the leading edge of the recording sheet 10 has returned to reside in front of the sheet edge detection flag 201*c*, the driving of the sheet feeding motor 9 is again reversed to be in the counterclockwise direction, and the PU roller 204 is driven in the clockwise direction to resume the sheet feeding of the recording sheet.

When the recording sheet is detected by the sheet edge detection flat 201*c*, the recording sheet is carried to the position of recording initiation (from the position 218 to the position 216 in FIG. 1). During this period, the recording sheet 10 is pinched by the carrying roller 12 and pressure roller 14, and when it faces the partly cut-off circle of the PU roller 204, the electromagnetic clutch 219 is turned off. Thereafter, the recording sheet is carried by the carrying roller 12 and the pressure roller 14. When the recording sheet 10 is carried to the position of recording initiation (the position 216 in FIG. 1), the sheet feeding roller 9 is suspended to initiate recording.

Figure 18:
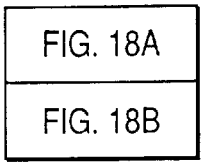
FIG. 18 is comprised of FIGS. 18A and 18B showing flowcharts of the operation of the ink jet recording apparatus, for which the present invention is applicable, from the reception of recording data to the initiation of recording in accordance with the third embodiment thereof.
Figure 18A:
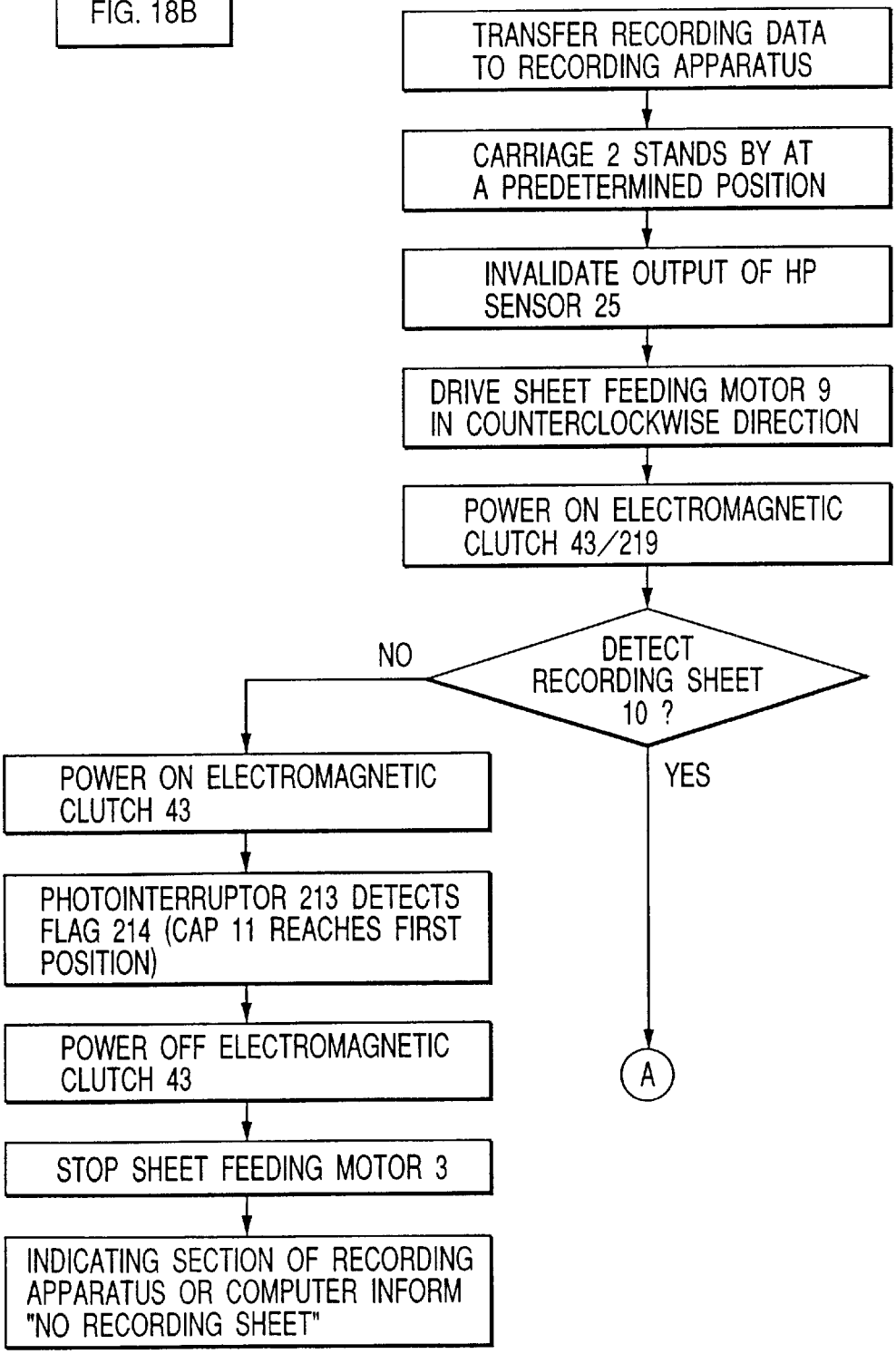
Figure 18B:
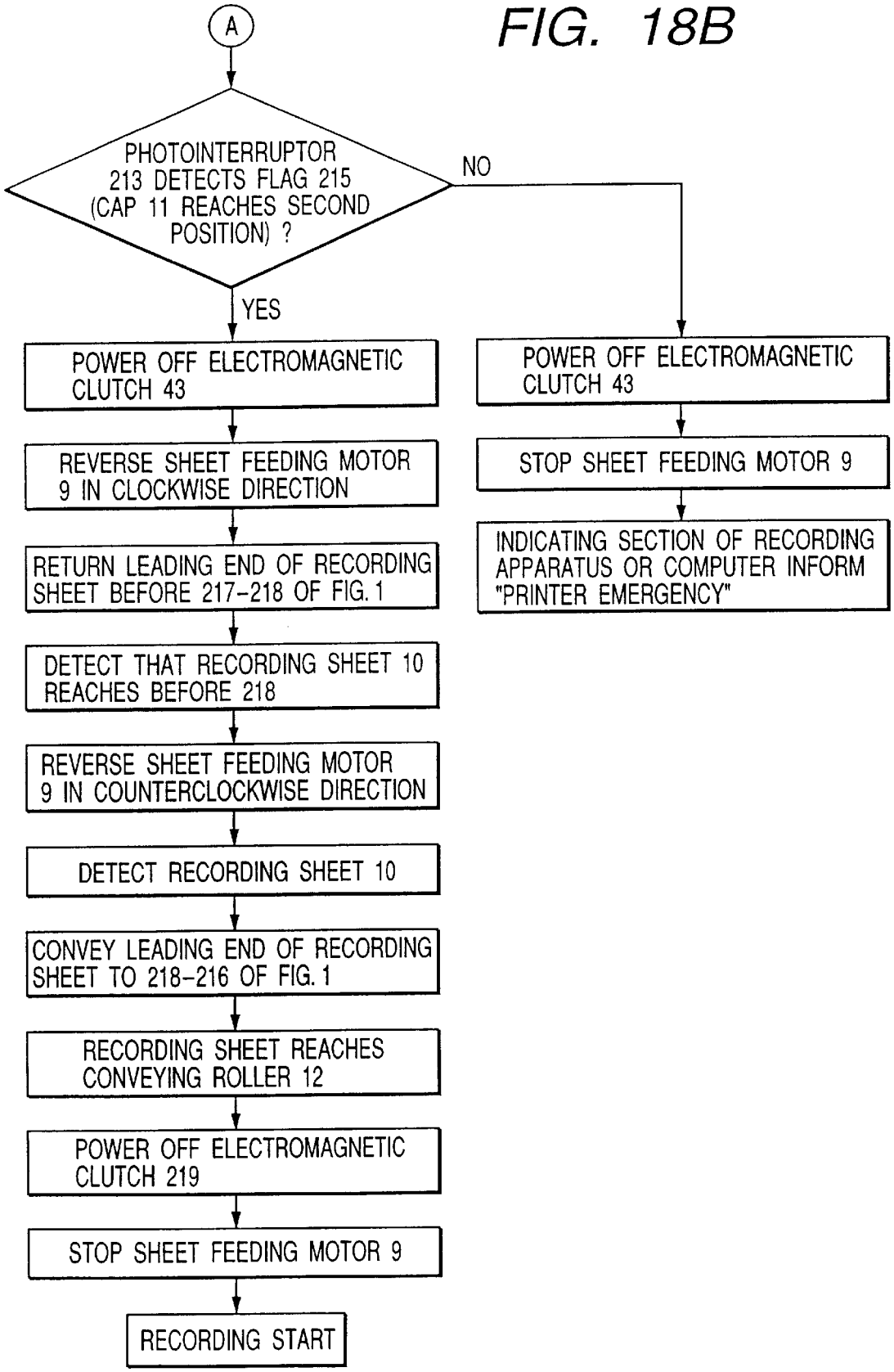

FIGS. 18A and 18B are flowcharts which show the operational sequence from the transmission of recording data to the initiation of recording as described above for the ink jet recording apparatus in accordance with the third embodiment shown in FIGS. 17A to 17C. In FIGS. 18A and 18B, the operation of the recording apparatus during recording and after the termination of recording is the same as that of the first embodiment and the second embodiment. Therefore, the detailed description thereof will be omitted. Here, during such period, the electromagnetic clutch 219 remains to be turned off, and the recording sheet 10 is separated by facing the partly cut-off circle of the PU roller 204. As a result, the second recording sheet 10 and on are left intact on the tray 203 until the next sheet feeding instruction is issued.

Fourth Embodiment

In accordance with each of the first to third embodiments described above, the structure is arranged so that the recording head 1 moves from the capping status shown in FIG. 1 and FIG. 4 at first, and then, the cap 11 moves to the second position (the position at which the recording medium 10 becomes passable) as shown in FIG. 5, and that after the termination of recording, the cap 11 returns to the first position at first, and then, the recording head 1 returns to the capping position. However, it may be possible to arrange the structure so that the aforesaid sequence is reversed. In other words, the cap 11 moves to the second position at first, and then, the recording head 1 moves. After termination of recording, the recording head 1 returns to the capping position at first, and then, the cap 11 returns to the first position. Now, with reference to FIG. 8 to FIG. 11B, the description will be made of an ink jet recording apparatus (a fourth embodiment) having the structure in which the aforesaid sequence is reversed.

Figure 8:
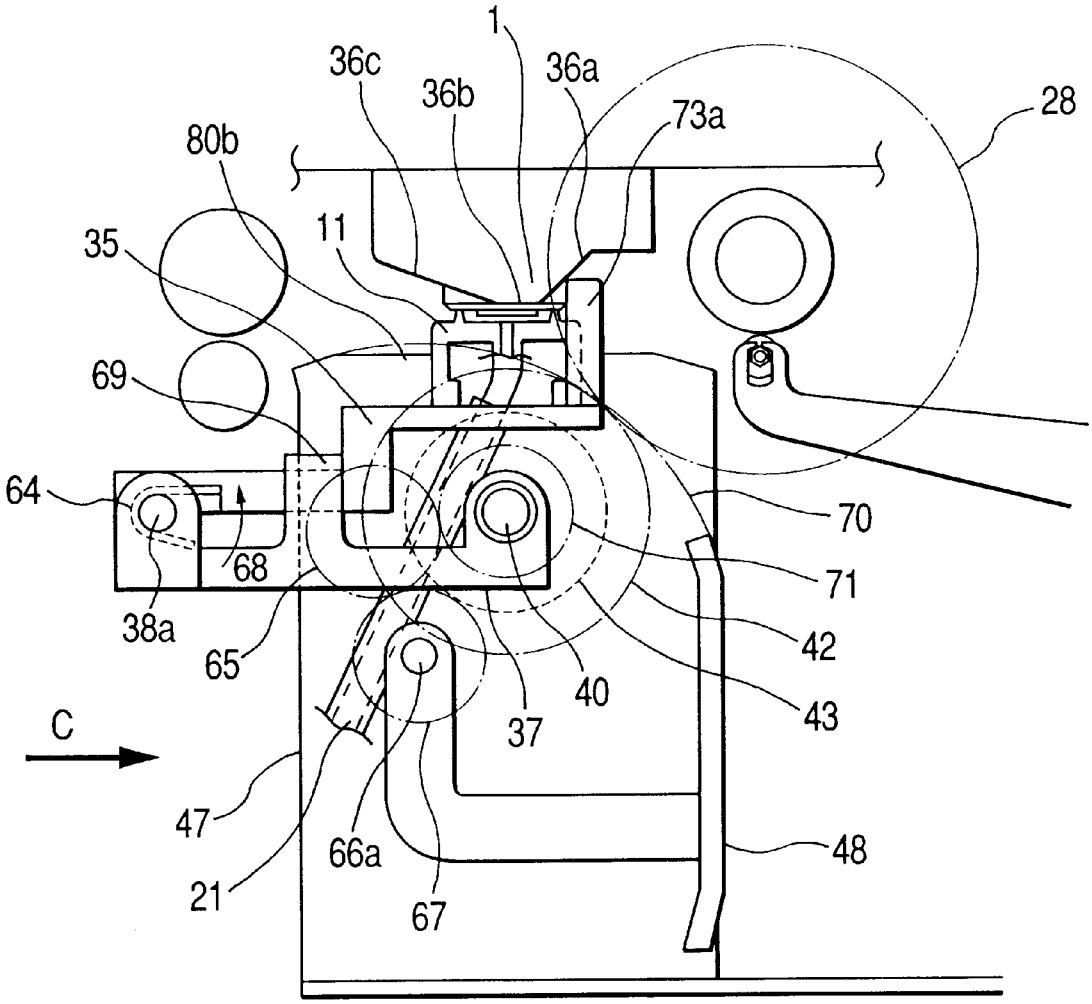
FIG. 8 is a partially enlarged side view which corresponds to the capping status shown in FIG. 4 of the ink jet recording apparatus to which the present invention is applicable in accordance with a fourth embodiment thereof.
Figure 9:
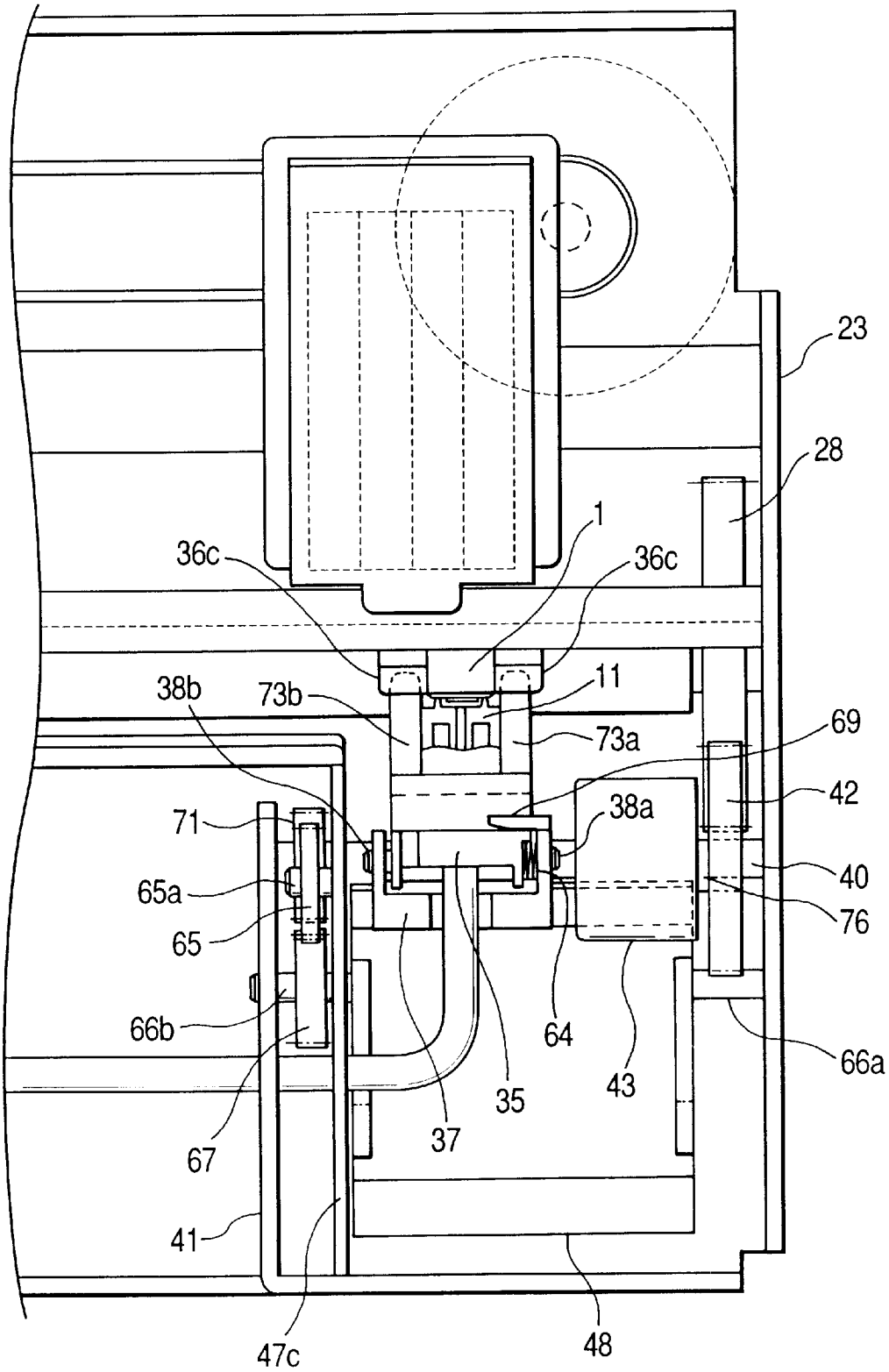
FIG. 9 is a partial front view which shows the principal part of the structure in accordance with the fourth embodiment, observed in the direction indicated by an arrow C in FIG. 8.

FIG. 8 is a side view which shows the principal structure of the fourth embodiment for the aforesaid sequence is reversed. FIG. 8 corresponds to FIG. 4 (the enlarged view of the portion at 52 in FIG. 1) which represents the first embodiment. FIG. 9 is a partial front view observed in the direction indicated by an arrow C in FIG. 8. Both FIG. 8 and FIG. 9 illustrate the standby state where the electric supply source is turned off. The cap 11 is at the first position (capping status). The structures of the portions which are not shown for the fourth embodiment are essentially the same as those of the first embodiment (FIG. 1 to FIG. 5). Also, the recording operation, the recovery operation, and the like of the fourth embodiment are essentially the same. Therefore, the detailed description thereof will be omitted. In FIG. 9, the arrangement of the second platen 48 and the structural parts around the cap 11 in the widthwise direction of the recording apparatus are the same as those of the first embodiment represented in FIG. 2, and since the structural parts around the cap 11 are arranged in the sheet passable area 50 (see FIG. 2), it becomes possible to attempt making an ink jet recording apparatus smaller by the width portion of the second platen 48 as compared with the conventional one.

In FIG. 8, a reference numeral 66*a* designates the platen rotational shaft, and the second platen 48 rotates with the platen rotational shaft 66*a* as fulcrum (to be described in detail later). Therefore, the rotational locus of the edge (outer edge) of the second platen 48 draws two-dotted chain line 70. This locus 70 is not overlapped with the traveling region of the recording head 1. As a result, in accordance with the present embodiment, the second platen 48 and the recording head 1 are not allowed to be in contact (collide) with each other even if the second platen 48 rotates from the state shown in FIG. 8, hence making it possible to operation in the sequence described earlier. In other words, it becomes possible to carry out an operation in such a sequence that from the capping condition, the cap 11 moves to the second position at first, and then, the recording head 1 moves, and that after the termination of recording, the recording head 1 returns to the capping position at first, and then, the cap 11 returns to the first position. Also, there is no possibility that the second platen 48 protrudes to the traveling region of the carriage 2 (recording head 1) even if the cap 11 should stop for some reasons between the first position and second position during its rotation. Therefore, at the time of such emergency as this, it is possible to stop the carriage 2 at the capping position.

In FIG. 8 and FIG. 9, a reference numeral 64 designates the twisted coil spring which is fixed through the shaft 38*a* formed for the cap base 35, and the cap base 35 is biased by the edge portion of the twisted coil spring 64 in the direction indicated by an arrow 68 (see FIG. 8); 69, a stopper formed for the rotation base 37, and the position at the upper limit of the cap base 35, which is biased in the direction indicated by the arrow 68, is regulated by the stopper 69. A rotational gear 42 is fixed to the input shaft 76, and the rotational gear 42 engages with the carrying roller gear 28. To the rotational shaft 40, which is the output shaft of the electromagnetic clutch 43, a second rotational gear 71 is fixed together with the rotation base 37.

A reference numeral 47*c* in FIG. 9 designates the side face portion of the first platen 47. In FIG. 8, neither the aforesaid side face portion 47 nor the side face portion 23 and bent portion 41 of the chassis 13 are shown. In FIG. 9, a reference numeral 65 designates the platen relay gear that engages with the second rotation gear 71. The platen relay gear 65 is rotatively supported by the central shaft 65*a* fixed to the side face 47*a* of the first platen 47. Reference numeral 66*a* and 66*b* designate the platen rotational shaft which is formed for the second platen 48, and one of the platen rotational shaft 66*a* is rotatively supported by the side face 23 of the chassis 13, and the other platen rotational shaft 66*b* is rotatively supported by the folded portion 41 of the chassis 13.

On the platen rotational shaft 66*b*, the platen rotation gear 67 is pressed to be fitted over and fixed, and the platen rotation gear 67 engages with the platen relay gear 65. Here, in the vicinity of the rotational shaft 40 on the side face 47*c* of the first platen 47 and the platen rotational shaft 66*b*, an opening (hole) or cutoff portion, which is larger than the outer shape of the second rotation gear 71 and the platen rotation gear 67, is formed in order to prevent any collision between components when being assembled.

Figure 10:
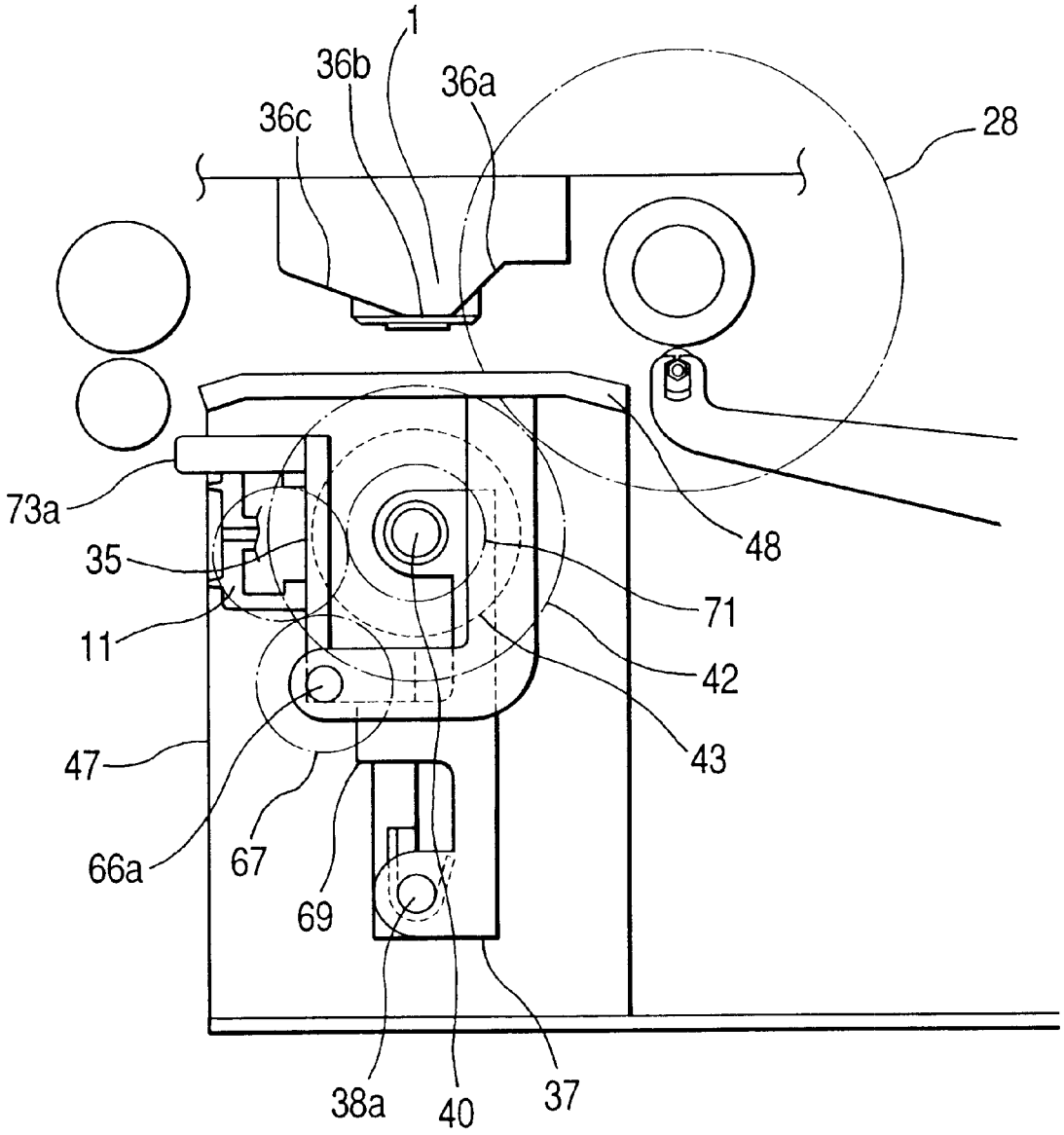
FIG. 10 is a partially enlarged side view which shows the principal part of the structure when the cap is at a second position in accordance with the fourth embodiment represented in FIG. 8.
Figure 11A:
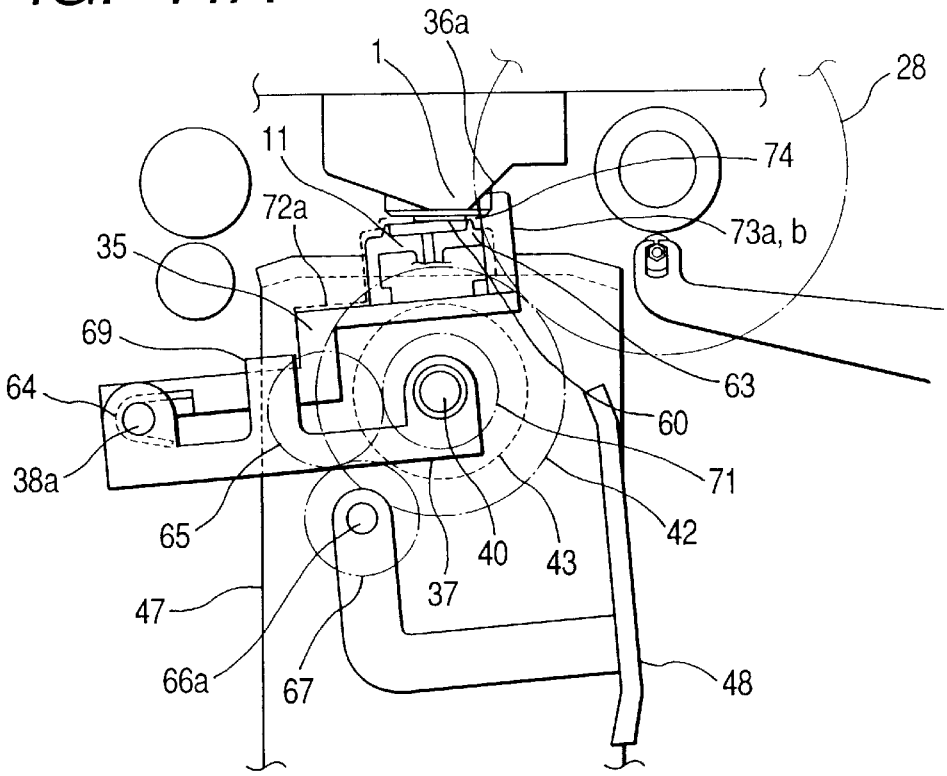
FIGS. 11A and 11B are partially enlarged views which illustrate the state where the cap is on the way of its shift from the first position to the second position in accordance with the fourth embodiment shown in FIG. 8.
Figure 11B:
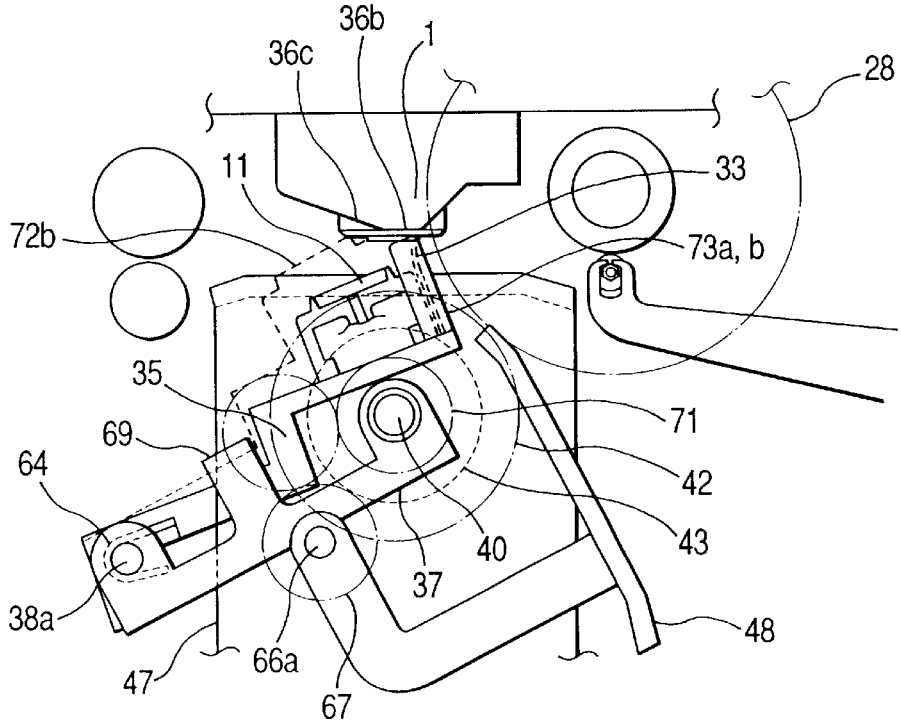

FIG. 10 is a side view which shows the structure of principal part of the fourth embodiment with the cap being at the second position, which corresponds to FIG. 8. FIGS. 11A and 11B are side views which illustrate the state of the cap being on the way of rotation from the first position shown in FIG. 8 to the second position shown in FIG. 10 in accordance with the fourth embodiment described above. Now, with reference to FIG. 10, and FIGS. 11A and 11B, the operation of the fourth embodiment will be described. In FIG. 8 to FIG. 10, when recording data are transmitted from a computer to a recording apparatus, the input shaft 76, the rotational shaft 40, and the rotation base 37 are brought into a state of being connected with each other by means of the electromagnetic clutch 43 being turned on in the state shown in FIG. 8. Then, as in the case of the embodiment described earlier, the sheet feeding motor 9 is driven to transmit the driving power to the rotation gear 42 and rotational shaft 40 through the motor gear 27, the relay gear 29, and the carrying roller gear 28, hence enabling the rotation base 37, the cap base 35, the cap 11, and the like, which are fixed thereto, to rotated in the counterclockwise in FIG. 8 to FIG. 10. At this juncture, the second rotation gear 71 also rotates in the counter-clockwise direction. The platen rotational gear 67 also rotates in the counterclockwise direction through the platen relay gear 65. Then, the second platen rotates in the counterclockwise direction centering on the platen rotational shafts 66*a* and 66*b*.

Here, with the platen relay gear 65 as an intermediate gear, the rotation base 37 and each of the components installed thereon are allowed to rotate in the same rotational direction at the same rotational speed as the second platen 48, because the gear ratio between the second rotation gear 71, the platen rotation gear 67 is set at 1:1. As a result, there is no possibility that these are in contact (collide) with each other while in rotation. In this respect, if it is desired to differentiate the rotational speeds of the second plate 48 and the rotation base 37 because of the arrangement relations between each of the components, it may be possible to set the gear ratio at a value different from the aforesaid ratio of 1:1.

When a predetermined time has elapsed or when it is detected by use of rotational angle detection means (not shown) or means for detecting the position of one arbitrary component that rotates (by use of photointerrupter and sensor flag, for instance) that the second platen 48 has arrived at the position where a recording sheet is made passable as shown in FIG. 10, the electromagnetic clutch 43 is turned off to disconnect the input shaft 76 and the rotational shaft 40, thus cutting off the transmission of the driving power from the sheet feeding motor 9, and enabling the carriage 2 to initiate its traveling. At this time, the cap 11 is at the second position where the recording sheet is made passable (conveyable). During the recording operation, the electromagnetic clutch 43 is turned off as in the embodiment described earlier, and the rotation of the rotational gear 42 is not transmitted to the rotation base 37. The cap 11 stays at the second position as it is.

Also, in the state shown in FIG. 10, the platen surface 80*a* of the second platen 48 is at the same height as the platen surface 80*b* of the first platen 47 (see FIG. 8). Thus, as in the embodiment described earlier, the second plate 48 cuts off between the cap 11 and the recording sheet during sheet feeding and recording. There is not possibility, therefore, that the recording sheet is stained by ink adhering to the cap 11. Also, during the recording of an image that needs a large amount of ink shooting, it is possible to reduce the cockling of the recording sheet uniformly all over the widthwise area of the recording sheet by means of the first platen 47 and the second platen 48. Here, as in the embodiment described earlier, the recording area exists also on the region on the carrying roller gear 28 side of the capping position of the carriage 2. Therefore, the position where the traveling direction of the carriage 2 is reversed at the time of recording is set a position (on the right side position in FIG. 9) on the carrying roller gear 28 side of the capping position.

As clear from the above description, the second platen 48 and the rotation base 37 share the sheet feeding motor 9 as the driving source therefore, and the second platen 48 is driven to rotate centering on the at platen rotational shafts 66*a* and 66*b*, and the rotation base 37 is driven to rotate centering on the rotational shaft 40.

In FIG. 8 to FIG. 10, reference numerals 73*a* and 73*b* designate retractive cams fixed to the cap base 35 or integrally formed therewith; 36*a*, 36*b*, and 36*c*, cam followers formed on both sides of the recording head 1 with discharge ports 60 between them. FIGS. 11A and 11B are views which illustrate the rotational movement of the aforesaid cap from the first position in FIG. 8 to the second position in FIG. 10. In conjunction with FIGS. 11A and 11B, the description will be made of the operation of the retractive cams 73*a* and 73*b*, the cam followers 36*a*, 36*b*, and 36*c*, and the circumferential members thereof. FIG. 11A shows the state where the rotation base 37 and the second platen 48 rotate in the counterclockwise direction several times from the capping status shown in FIG. 8 centering on the rotational shaft 40 and the platen rotational shafts 66*a* and 66*b*.

At this juncture, the retractive cams 73*a* and 73*b* are pressed down by being in contact with the cam followers (slanted surface portion) 36*a*, and the cap base 35 and the cap 11 rotates from the position indicated by chain lines 72*a* to the position indicated by solid lines with the shafts 38*a* and 38*b* as fulcrum (center). The cap base 35 is biased by the twisted coil spring 64 put through the shaft 38*a* in the direction toward the recording head 1 at all times. As a result, the retractive cam 73*a* integrally arranged with the cap base 35 are allowed to rotate, while abutting against the cam follower 36*a*. At this time, a gap 74 is maintained between the slanted line portion 63 of the leading rib of the cap 11, and the discharge port portion 60 of the recording head 1, hence the cap 11 being able to rotate thereafter without rubbing the recording head 1.

FIG. 11B shows the state where the rotation base 37 and the second 48 platen further rotate in the counterclockwise direction from the state shown in FIG. 11A. At this juncture, the retractive cams 73*a* and 73*b* has advanced to the position of the cam follower 36*b*, and the cap base 35 and the cap 11 are allowed to rotate from the position indicated by the chain lines 72*b* to the position indicated by the solid lines with the shafts 38*a* and 38*b* as fulcrum (center). In this respect, if a wiping member 33 is arranged between the retractive cams 73*a* and 73*b* on the left and right sides, it may be possible to remove ink droplets adhering to the circumference of the discharge port portion 60 by wiping them during rotation as shown in FIG. 11B.

When the rotation base 37 and the second platen 48 rotate further in the counterclockwise direction from the state shown in FIG. 11B, the retractive cams 73*a* and 73*b* pass the cam followers 36*b* and 36*c*, and the cap 11 arrives at the second position shown in FIG. 10. At this position 10 shown in FIG. 10, the cap base 35, which is biased by means of the twisted coil spring 64, is regulated by the stopper portion 69 of the rotation base 37 to a position (the upper limit position). In the state shown in FIG. 10, the recording sheet 10 is made passable (conveyable) along the platen surfaces 80*b* and 80*a* formed by the first platen 47 and second platen. Then, in this state, recording is performed by the recording head 1 mounted on the carriage 2 on the recording sheet thus fed.

After the termination of recording, the status shown in FIG. 10 returns to the capping status shown in FIG. 8 by way of reversely executing the operation described above. In other words, the retractive cams 73*a* and 73*b* return to the state shown in FIG. 8 through the states shown in FIG. 11B to FIG. 11A, while being in contact with the cam followers in order of 36*c*→36*b*→36*a*, which is reverse to the one described above. In accordance with the present embodiment, the structure for the retractive cams 73*a* and 73*b*, the cam followers 36*a*, 36*b*, and 36*c*, and the wiping member 33 is arranged with the positional relationship described above. As a result, there is no possibility that the cap 11 rubs the discharge port portion 60 while the cap 11 rotates, hence making it possible to prevent the cap 11 and the discharge port portion 60 (discharge port surface 91) from being damage or broken. Also, the ink droplets that adhere to the circumference of the discharge port portion 60 can be removed reliably by wiping them off by means of the wiping member 33.

Fifth Embodiment

As regards the recording medium carrying path where the recording sheets 10 having various kinds of widths are allowed to pass, respectively, at the position facing the ink jet recording head 1, each of the above embodiments described in detail is structured so that a part of the platen surface (part of the position that can face the recording head 1 that discharges ink for the execution of recording) is made the opening for a cap serving as recovery means on the side opposite to the side where the recording head 1 is arranged. For an ink jet recording apparatus of a fifth embodiment given below, however, is the one for which the aforesaid recovery means is arranged with respect to the recording medium carrying path on the same side as the recording head 1 at a position facing the recording medium carrying path. The present invention is applicable to such an ink jet recording apparatus as arranged above. In an ink jet recording apparatus of the kind, the cap 11 serving as recovery means is arranged to face the recording surface of a recording sheet which has been carried to the recording position that faces the recording head 1, and with respect to the recording head 1, this means is positioned on the upstream side or the downstream side in the carrying direction of the recording sheet so as not to impede serial traveling of the recording head 1.

The recovery mechanism for an ink jet recording apparatus of the kind is arranged to move the recording head 1 together with a carriage with the provision of a mechanism that enables the carriage rail 3 to be displaced at first in the direction in which it parts from the recording surface. In this manner, it becomes possible to adopt a structure to perform capping by shifting the cap 11 by use of a cap movement mechanism into the gap between the recording head 1 and the recording medium carrying path (the platen surface) which is now made wider, or it may be possible to adopt a structure so that capping is executed by shifting only the recording head 1 from the recording position to the position where the cap 11 exists without displacing the cap 11. For an ink jet recording apparatus of the kind, it becomes possible, as in each of the embodiments described earlier, to suppress the width of serially traveling area of the carriage to the width of a recording sheet, that is, while suppressing it to the same size as the passage width of the recording medium carrying path, an ink jet recording can be performed fully on the specific width of a recording sheet, and the recovery process can be executed for maintaining or recovering the discharge function of the ink jet recording head 1 as well.

Also, with an ink jet recording apparatus of the kind, it is possible to apply the relative movement of the recording head 1 and the cap 11, as well as the carrying control of a recording sheet for each of the embodiments described earlier, and to demonstrate the effects of the respective embodiments. In addition, since the recording head 1 and the cap 11 are arranged on the same side for the recording medium carrying path, there is no possibility that the conveyance of a recording sheet is hindered even when the recording sheet should be carried while no recording is performed. The relative shifts of the recording head 1 and the cap 11 can be made to execute a recovery process as required.

Sixth Embodiment

Each of the above embodiments described in detail is an apparatus of a type where an ink jet recording head 1 is mounted on the carriage 2 which serves as an installation unit for the recording head, and serially traveled in order to make it possible to record on the entire area of a recording sheet in the widthwise direction. However, it is possible to apply the present invention to an ink jet recording apparatus of the so-called full-line type where ink discharge ports are arranged in line with respect to the entire width of a recording sheet in accordance with each of the embodiments described above. In such case, the structure is arranged for the first to fourth embodiments so that the entire area of the platen surface moves, and the cap opening appears on the entire area thereof. Also, for the fifth embodiment, the structure is arranged so that the cap, which is provided with the cap opening to cover the entire ink discharge ports of the full-line head, is arranged in parallel with the full-line head on the upstream side or the downstream side of the full-line head. For the present embodiment, it is possible to apply the present invention to the carrying control of a recording sheet corresponding to the relative shift of the full-line head and the cap or to the relative shift control of the full-line head corresponding to the carrying condition of a recording sheet and the cap. Then, a measure can be taken with respect to a required recovery process. Furthermore, since the recording head is of full-line type, it becomes possible to execute ink jet recording at high speed.

Other Embodiments

In this respect, the present invention is equally applicable to a color recording apparatus capable of recording in ink of different colors or a gradation recording apparatus that records in different densities using one and the same color or, further, to an ink jet recording apparatus that records by use of a plurality of different ink as if an recording apparatus made available by combining them, besides an ink jet recording apparatus that records by use of one recording head, and the present invention is equally capable of attaining the same effects by use of any one of them.

Further, the present invention is equally applicable and obtaining the same effects irrespective of the structural arrangement of a recording head and an ink tank, such as a structure that uses an ink jet cartridge where a recording head and an ink tank are integrally and exchangeably formed, a structure that uses a recording head and an ink tank separately, where an ink supply tube or the like is used between them, among some others.

As clear from the above description, the present embodiment makes it possible to provide an ink jet recording apparatus for which the dimension of the apparatus main body is made significantly smaller in the direction of the carriage traveling without inviting any increased load on the carriage motor or inviting any increase of dead space irrespectively of the size of a recovery system.

Also, in accordance with the present embodiment, it becomes possible to provide an ink jet recording apparatus capable of reliably preventing the leading edge of a recording medium from being protruded beyond carrying means without any possibility that the recording medium enters a gap between recording means and capping means to rub the discharge port surface or the leading edge of the recording medium abuts against the cap or recording means to stain or spoil the recording medium with ink.

Further, in accordance with the present embodiment, it is possible to provide an ink jet recording apparatus capable of reducing the positional fluctuation when recording is initiated, and also, capable of stopping the operation of recording device exactly at the time of any emergency in recording.

Further, in accordance with the present embodiment, it is possible to provide an ink jet recording apparatus capable of removing or installing recording means or ink holding means even if the carriage cannot return to the carriage position due to an emergency in capping means and the circumference thereof.

Further, in accordance with the present embodiment, it is possible to provide an ink jet recording apparatus capable of informing the user of an emergency in recording device, and of the timing at which to remove or install recording means or ink holding means.

Further, in accordance with the present embodiment, it is possible to provide an ink jet recording apparatus capable of keeping recording means on standby in the capping status when recording medium is not set on the recording apparatus.

Further, in accordance with the present embodiment, it is possible to provide an ink jet recording apparatus capable of informing the user of no recording medium being set.

Further, in accordance with the present embodiment, it is possible to provide an ink jet recording apparatus in which the second platen is not allowed to collide with the carriage or recording means even when the rotating locus of the second platen at has the overlapping positional relations with the traveling area of the carriage and recording means.

Further, in accordance with the present embodiment, it is possible to provide an ink jet recording apparatus which does not allow the carriage to stop at the home position during recording.

Further, in accordance with the present embodiment, it is possible to provide an ink jet recording apparatus provided with control means capable of optimizing the relative movements of the recording head installation unit and recovery means, and the conveyance of a recording medium as well.

Further, in accordance with the present embodiment, it is possible to provide an ink jet recording apparatus capable of performing the optimal control for carrying a recording medium corresponding to the relative movements of the recording head installation unit and recovery means.

Further, in accordance with the present embodiment, it is possible to provide an ink jet recording apparatus capable of the optimal control for the relative movements of the recording head and recovery means corresponding to the carrying condition of a recording medium.

What is claimed is:

1. An ink jet recording apparatus performing a recovery process for recording means by a recovery system having capping means being closely in contact with or parting from the recording means which is detachably installed on a head installation unit for recording by discharging ink to a recording medium, the ink jet recording apparatus comprising:

a carrying path for carrying a recording medium to pass a position facing the recording means;

cap driving means being at a position to face said carrying path for moving said capping means to a first position to enable said capping means to be closely in contact with said recording means, and to a second position to enable said recording medium to be carried;

cap position detecting means for detecting the position of said capping means;

cap driving control means for initiating driving of said capping means from said first position by said cap driving means, and for suspending driving when detecting the arrival of the capping means at said second position in accordance with an arbitrary timing of transferring data to a main body of the apparatus, or in accordance with an initiation of feeding said recording medium, or the detection of a recording medium by recording medium detection means which detects that said recording medium is set on said main body, and for initiating driving of said capping means from said second position by said cap driving means corresponding to an exit of said recording medium from the apparatus, and for suspending driving of said capping means when detecting the arrival of said capping means at said first position; and carrying means for carrying said recording medium and being arranged for said ink jet recording apparatus on the upstream side of said recording means in a carrying direction of said recording medium, said carrying means being driven in a direction opposite to a direction during recording while said capping means is driven by said cap driving means from said first position to said second position.

2. An ink jet recording apparatus according to claim 1, wherein said recording medium detection means is positioned on the upstream side of said carrying means in the carrying direction, wherein when said cap driving means is suspended with the arrival of said capping means at said second position from said first position, a recording medium is carried by said carrying means to a position of recording initiation in the case that a recording medium is not detected by said recording medium detection means, and wherein when a recording medium is detected by said recording medium detection means, the recording medium is carried by said carrying means in a predetermined amount to the position of recording initiation with the position of said carrying means as reference after said carrying means is driven in the direction opposite to the direction during recording in a predetermined period of time.

3. An inkjet recording apparatus according to claim 1, wherein said recording medium detection means is positioned on the upstream side of said carrying means in the carrying direction, and wherein when a recording medium is detected after said cap driving means is suspended with the arrival of said capping means at said second position from said first position, the recording medium is again fed after being returned to the upstream side of said recording medium detection means in the carrying direction, and said recording medium is carried by said carrying means in a predetermined amount to the position of recording initiation with the position of said carrying means as reference.

4. An ink jet recording apparatus according to claim 1, wherein said cap driving means is suspended and the carrying of recording medium is stopped in the case that the arrival of capping means at said second position from said first position, or at said first position from said second position, is not detected by said cap position detecting means within a predetermined time from the driving initiation of said cap driving means, or in the case that said capping means stops at said first position or at said second position.

5. An ink jet recording apparatus according to claim 4, wherein said cap driving means is driven in reverse and said capping means returns to said first position or to said second position when the arrival of said capping means at said second position from said first position, or at said first position from said second position, is not detected, and wherein when the arrival of said capping means at said first position or at said second position is not detected within a predetermined time from reversing of driving said cap driving means, said driving of said cap driving means is suspended.

6. An ink jet recording apparatus according to claim 4, said ink jet recording apparatus further comprising a carriage for carrying said head installation unit and a controller which sends an operational status of the recording apparatus to an electronic equipment connected with said recording apparatus after the feeding of a recording medium is suspended or after said carriage is suspended.

7. An inkjet recording apparatus according to claim 4, further comprising indication means for indicating an operational status of the recording apparatus after the feeding of a recording medium is suspended.

8. An ink jet recording apparatus according to claim 1, further comprising a carriage for carrying said head installation unit, and wherein during a period of driving said capping means from said first position to said second position, or from said second position to said first position, said carriage is stopped at an arbitrary position other than the capping position, to enable the detachment or attachment of said recording means at said arbitrary position.

9. An ink jet recording apparatus according to claim 1, wherein the feeding of a recording medium is suspended when a recording medium is not detected within a predetermined time, and after that, said capping means is driven to said first position by said cap driving means, and the driving of said capping means is suspended when the arrival of said capping means at said first position is detected.

10. An ink jet recording apparatus according to claim 9, wherein after said cap driving means is suspended, an operational status of said recording apparatus is sent from said recording apparatus to an electric equipment connected with said recording apparatus.

11. An ink jet recording apparatus according to claim 9, further comprising indication means for indicating an operational status of the recording apparatus after the feeding of a recording medium is suspended.

12. An ink jet recording apparatus according to claim 1, further comprising a carriage for carrying said head installation unit, wherein said carriage moves in a main scanning direction from a slate in which said capping means is closely in contact with said recording means, and then said capping means of said recovery system is driven from said first position to said second position by said cap driving means, and after recording, said capping means of said recovery system is driven from said second position to said first position by said cap driving means, and then said carriage returns to the first position.

13. An ink jet recording apparatus according to claim 1, further comprising a carriage for carrying said head installation unit, wherein said capping means of said recovery system is driven from said first position to said second position from a state of said capping means being closely in contact with recording means, and then, said carriage moves in a main scanning direction to perform recording, and after recording, said carriage returns to the first position, and then, said capping means of said recovery system is driven from said second position to said first position.

14. An inkjet recording apparatus according to claim 1, further comprising a carriage for carrying said head installation unit, wherein said cap position detecting means is positioned in a carrying range of a recording medium in a main scanning direction and detects said carriage being at the capping position, wherein an output of said cap position detecting means is invalidated during recording, and wherein the output of said cap position detecting means is validated after a termination of recording or after the recording medium exits the recording apparatus.

15. An ink jet recording apparatus according to claim 1, wherein said recording means is provided with electrothermal converting elements for generating thermal energy used for discharging ink.

16. An ink jet recording apparatus according to claim 15, wherein said recording means utilizes film boiling created in ink by the thermal energy generated by said electrothermal converting elements for discharging ink from discharge ports.

17. An ink jet recording apparatus according to claim 1, further comprising a platen positioned to face said recording means to support a backside of said recording medium, said platen having a supporting surface a portion of which is retracted to enable said capping means to face said recording means.

18. An inkjet recording apparatus performing a recovery process for recording means by a recovery system having capping means being closely in contact with or parting from recording means installed on a head installation unit for recording by discharging ink to a recording medium, the ink jet recording apparatus comprising:

cap driving means for moving said capping means to a first position to enable said capping means to be closely in contact with said recording means, and to a second position to enable said recording medium to be carried;

cap position detecting means for detecting the position of said capping means; and cap driving control means for suspending said cap driving means in the case that the arrival of said capping means at said second position from said first position, or at said first position from said second position, is not detected within a predetermined time from the driving initiation by said cap driving means or in the case that said capping means remains suspended at said first position or at said second position.

19. An ink jet recording apparatus according to claim 18, wherein in the case that arrival of said capping means at said second position from said first position, or at said first position from said second position, is not detected, said cap driving control means reverses the driving of said cap driving means to drive said capping means to return to said first position or said second position, and when return of said capping means to said first position or said second position is not detected within a predetermined time since the reverse driving of said cap driving means, driving of said cap driving means is suspended.

20. An ink jet recording apparatus according to claim 18, further comprising a platen positioned to face said recording means to support a backside of said recording medium, said platen having a supporting surface a portion of which is retracted to enable said capping means to face said recording means.

21. An ink jet recording apparatus according to claim 18, wherein said recording means is provided with electrothermal converting elements for generating thermal energy used for discharging ink.

22. An ink jet recording apparatus according to claim 21, wherein said recording means utilizes film boiling created in ink by thermal energy generated by said electrothermal converting elements for discharging ink from discharge ports.

* * * * *

UNITED STATES PATENT AND TRADEMARK OFFICE

CERTIFICATE OF CORRECTION

PATENT NO. : 6,474,774 B1
DATED : November 5, 2002
INVENTOR(S) : Okamoto

It is certified that error appears in the above-identified patent and that said Letters Patent is hereby corrected as shown below:

Column 1,
Line 12, "function" should read -- functions --.

Column 6,
Line 19, "kinds" should read -- kind --.

Column 8,
Line 2, "Electro-magnetic" should read -- electromagnetic --.

Column 12,
Line 8, "photo-interrupter" should read -- photointerrupter --; and
Line 18, "sheet-edge" should read -- sheet edge --.

Column 14,
Line 44, "electro-magnetic" should read -- electromagnetic --.

Column 15,
Lines 40 and 50, "electro-magnetic" should read -- electromagnetic --.

Column 17,
Line 17, "rubbed" should read -- rubbing --; and
Line 19, "FIG. 7C" should read -- ¶ FIG. 7C --.

Column 18,
Line 3, ""electro-magnetic" should read -- electromagnetic --; and
Line 22, "counter-clockwise" should read -- counterclockwise --.

Column 19,
Line 17, "began" should read -- begun --.

Column 21,
Line 3, "counter-clockwise" should read -- counterclockwise --.

Column 22,
Line 5, "and on" should read -- and so on --.

UNITED STATES PATENT AND TRADEMARK OFFICE

CERTIFICATE OF CORRECTION

PATENT NO. : 6,474,774 B1
DATED : November 5, 2002
INVENTOR(S) : Okamoto

It is certified that error appears in the above-identified patent and that said Letters Patent is hereby corrected as shown below:

Column 23,
Line 65, "counter-clockwise" should read -- counterclockwise --.

Column 24,
Line 38, "not" should read -- no --;
Line 64, space after "with" should be deleted; and
Line 65, space before "FIGs. 11A" should be deleted.

Column 26,
Lines 1 to 67, should be deleted.

Column 27,
Lines 1 to 23, should be deleted.

Signed and Sealed this

Twenty-eighth Day of October, 2003

JAMES E. ROGAN
*Director of the United States Patent and Trademark Office*